United States Patent [19]

Welsh et al.

[11] 4,063,229

[45] Dec. 13, 1977

[54] ARTICLE SURVEILLANCE

[75] Inventors: John Welsh, North Canton, Ohio; Richard N. Vaughan, Sydney, Australia

[73] Assignee: Sensormatic Electronics Corporation, Hollywood, Fla.

[21] Appl. No.: 1,970

[22] Filed: June 28, 1971

Related U.S. Application Data

[63] Continuation of Ser. No. 639,250, March 30, 1967, abandoned.

[51] Int. Cl.[2] ..... G08B 21/00

[52] U.S. Cl. ..... 340/280; 325/8; 343/6.5 SS

[58] Field of Search ..... 325/8; 340/280

[56] References Cited

U.S. PATENT DOCUMENTS

| | | | |
|---|---|---|---|
| 2,774,060 | 12/1956 | Thompson | 340/258 C |
| 3,098,971 | 7/1963 | Richardson | 325/9 |
| 3,384,892 | 5/1968 | Postman | 343/6.5 SS |
| 3,493,955 | 2/1970 | Minasy | 340/280 X |
| 3,518,546 | 6/1970 | Augenblick et al. | 325/8 |
| 3,711,848 | 1/1973 | Martens | 340/280 |
| 3,754,226 | 8/1973 | Fearon | 340/280 |

FOREIGN PATENT DOCUMENTS

| | | | |
|---|---|---|---|
| 763,681 | 5/1934 | France | 340/258 C |

*Primary Examiner*—David L. Trafton
*Attorney, Agent, or Firm*—Watson, Leavenworth, Kelton & Taggart

[57] ABSTRACT

Sensor-emitter labels or tags containing a two-terminal nonlinear capacitor, e.g., a semiconductor diode, directly connected to antenna means are applied to articles for purpose of surveillance. A transmitter coupled to an antenna establishes an electromagnetic wave field above about 100 MHZ, and preferably about 915 MHZ, within a surveillance zone. Introduction of said label or tag into said zone causes reradiation of a different signal distinguishable from the signal produced by said transmitter and otherwise occupying said zone. Various embodiments are disclosed capable of reradiating a second harmonic signal. A receiver associated with said transmitter and tuned to the reradiated signal detects the presence of said label or tag and activates a signal or alarm. Various tracking arrangements between transmitter and receiver are disclosed for accommodating frequency drift in the transmitter.

Saturable ferrite layers, fusible links, magnetic switches and the like are described associated with the labels or tags to allow for deactivation. Various deactivation devices are disclosed including radio frequency generators for burning out the nonlinear capacitor or diode.

28 Claims, 36 Drawing Figures

INVENTORS
JOHN WELSH,
LLOYD L. GORDON &
RICHARD N. VAUGHAN

BY William R. Holland
ATTORNEY

INVENTORS
JOHN WELSH,
LLOYD L. GORDON &
RICHARD N. VAUGHAN
BY
William R. Holland
ATTORNEY INVENTORS
JOHN WELSH,
LLOYD L. GORDON &
RICHARD N. VAUGHAN
BY William R. Holland
ATTORNEY INVENTORS
JOHN WELSH,
LLOYD L. GORDON &
RICHARD N. VAUGHAN
BY William R. Holland
ATTORNEY INVENTORS
JOHN WELSH,
LLOYD L. GORDON &
RICHARD N. VAUGHAN
BY
William R. Holland
ATTORNEY INVENTORS
JOHN WELSH,
LLOYD L. GORDON &
RICHARD N. VAUGHAN
BY
William R. Holland
ATTORNEY

70

INVENTORS
JOHN WELSH,
LLOYD L. GORDON &
RICHARD N. VAUGHAN

BY William R. Holland
ATTORNEY

INVENTORS
JOHN WELSH,
LLOYD L. GORDON &
RICHARD N. VAUGHAN

BY William R. Holland
ATTORNEY

INVENTORS
JOHN WELSH,
LLOYD L. GORDON &
RICHARD N. VAUGHAN
BY William R. Holland
ATTORNEY

INVENTORS
JOHN WELSH,
LLOYD L. GORDON &
RICHARD N. VAUGHAN

BY William R. Holland
ATTORNEY

INVENTORS
JOHN WELSH,
LLOYD L. GORDON &
RICHARD N. VAUGHAN
BY
William R. Holland
ATTORNEY INVENTORS
JOHN WELSH,
LLOYD L. GORDON &
RICHARD N. VAUGHAN
BY William R. Holland
ATTORNEY INVENTORS
JOHN WELSH,
LLOYD L. GORDON &
RICHARD N. VAUGHAN
BY
William R. Holland
ATTORNEY INVENTORS
JOHN WELSH,
LLOYD L. GORDON &
RICHARD N. VAUGHAN
BY
William R. Holland
ATTORNEY INVENTORS
JOHN WELSH,
LLOYD L. GORDON &
RICHARD N. VAUGHAN
BY
William R. Holland
ATTORNEY

INVENTORS
JOHN WELSH,
LLOYD L. GORDON &
RICHARD N. VAUGHAN

BY William R. Holland
ATTORNEY

INVENTORS
JOHN WELSH,
LLOYD L. GORDON &
RICHARD N. VAUGHAN
BY
William R. Holland
ATTORNEY

ARTICLE SURVEILLANCE

This application is a continuation of application Ser. No. 639,250, filed Mar. 30, 1967, for "ARTICLE SURVEILLANCE."

The present invention relates generally to article surveillance techniques and systems and associated methods, devices, and products. More particularly, the present invention relates to electromagnetic wave or electrical space energy techniques and systems for detecting articles or objects under surveillance. More specifically, the invention relates to radio frequency and microwave techniques and allied systems for inventory or merchandise control and pilferage detection.

Among the foremost of the virtual myriad of article surveillance problems and applications to which the disclosure of the present invention is addressed are those relating to theft detection in general merchandising and retail stores and outlets. Especially since the advent and spread of self-service modes of retailing goods, financial losses due to inventory shrinkage from theft and shoplifting have risen to staggering proportions.

Effective detection and apprehension of shoplifters and kleptomaniacs is rendered extremely difficult by virtue of the clever and surreptitious methods employed by these persons, as well as the problems posed by possible false arrest or false imprisonment charges. Moreover, sufficiently comprehensive personal supervision of shoppers, through employment of forces of store guards and detectives and utilization and monitoring of elaborate closed-circuit television systems, mirrors, watch stations, and the like, incurs inordinate investment in equipment and creates exorbitant overhead expenses for the retailer, while remaining to be a relatively ineffective method.

Recently, certain automatic magnetic detection schemes have been proposed as a solution to the problems. These systems employ discs, medallions, rods, or similar pieces of soft iron or ferromagnetic material having a low retentivity. The pieces are magnetized and attached to the objects to be protected from theft and are demagnetized or removed when removal of the objects from the premises under surveillance is authorized. If the pieces are not demagnetized or removed, they are detected by search coils or magnetic fields maintained at the exits for the premises, thereby triggering an alarm or locking the exit. However, the system is devoid of any selectivity in that foreign ferromagnetic objects, such as belt buckles, keychains, watches, and the like, will falsely trigger the alarms and related mechanisms. Furthermore, where a relatively high frequency a. c. magnetic detection field is utilized, nonmagnetic metal objects which are conductive may falsely trigger the system through the creation of eddy current effects.

To compensate for the absence of selectivity, these prior systems have required drastic compromises in sensitivity adjustments, so as to maintain null thresholds above the level of spurious effects produced by foreign objects. These null adjustments have necessitated the use of ferromagnetic detection pieces of high quality magnetic material and of substantial size and mass. Thus, the pieces are not only too expensive for application to most general merchandise commodities, but they are also readily discernable so that a shoplifter may simply remove the pieces and abscond with the goods undetected. Moreover, the pieces may not be detected if they are carefully aligned in the direction of the exit detection field during removal from the premises so as to create minimum magnetic flux interceptions or absorption.

More recently, somewhat more sophisticated radio frequency detection systems have been developed in an attempt to attain a solution to the problems of achieving a proper balance of sensitivity and selectivity. These concepts have encompassed the use of encapsulated miniature transmitter modules, with self-contained power supplies, attached to the objects or merchandise sought to be protected from pilferage. The transmitter modules, if not detached from the objects or merchandise to authorize their removal from the premises, will transmit signals to receiver-alarm units positioned at the exits.

However, despite the advances of recent years in microelectronics in terms of economics of materials and manufacture and miniaturization, the transmitter modules are still too expensive for general application and can only be justified economically for protection of more valuable objects and merchandise. Moreover, the transmitter modules are rendered readily noticeable by their necessarily significant and discrete size; consequently the modules may be removed, and detection of theft avoided. To counteract this deficiency in the system concept, it has been necessary to provide elaborate and expensive equipment for riveting or otherwise firmly attaching the modules to the merchandise, as well as similar apparatus for shearing the rivets or otherwise detaching the modules for authorized removal of the goods from the protected premises. The attendant additional expense and inconvenience has thus further limited practical application of the concept to only more valuable goods.

In addition to the above-described disadvantages, the transmitter module power supplies deteriorate and must be replaced or recharged, thus creating further expense, inconvenience, and possibility of system error or malfunction. Moreover, the exit receiver-alarm may not be positioned in conveniently close proximity to the checkout station or stocks of inventory; or possible spurious and reinforced or reverberated signals from the transmitter modules could cause false triggering of the system.

It is therefore an object of the present invention to provide simplified, economical, and reliable article surveillance systems and methods affording optimum selectivity and sensitivity and alleviating or substantially eliminating the aforesaid problems.

It is a further object of the invention to furnish improved systems and methods as aforesaid utilizing electromagnetic wave or electrical space energy transmission and reception devices and techniques.

It is a still further object of the invention to provide novel radio wave transmitter and receiver units, employing unique component combinations and circuitry, for article surveillance, inventory control, and theft detection.

It is another object of the invention to provide such transmitter and receiver units operable in high frequency or microwave regions of the electromagnetic wave spectrum, with minimal power requirements and without creating objectionable radio noise or interference.

It is yet another object of the invention to provide improved systems and methods for article surveillance as aforesaid using novel and inexpensive sensor and emitter elements adapted to be conveniently and unobtrusively affixed to or embedded in articles or merchandise.

It is yet another object of the invention to provide systems and methods for selectively deactivating or desensitizing such sensors and emitters.

These and other objects and advantages of the present invention, together with structural variations, additional applications, and substitutions of equivalent components and steps, will become apparent to those skilled in the art upon reference to the detailed description in the following specification in conjunction with the illustrations in the accompanying drawings of preferred embodiments, it being understood that such variations, applications, and equivalents are comprehended within the scope and spirit of the invention and that the invention is to be measured solely by the scope of the appended claims.

In the drawings, in which like reference characters are employed to designate like parts, assemblies, circuits, and components, throughout:

Figure 4:
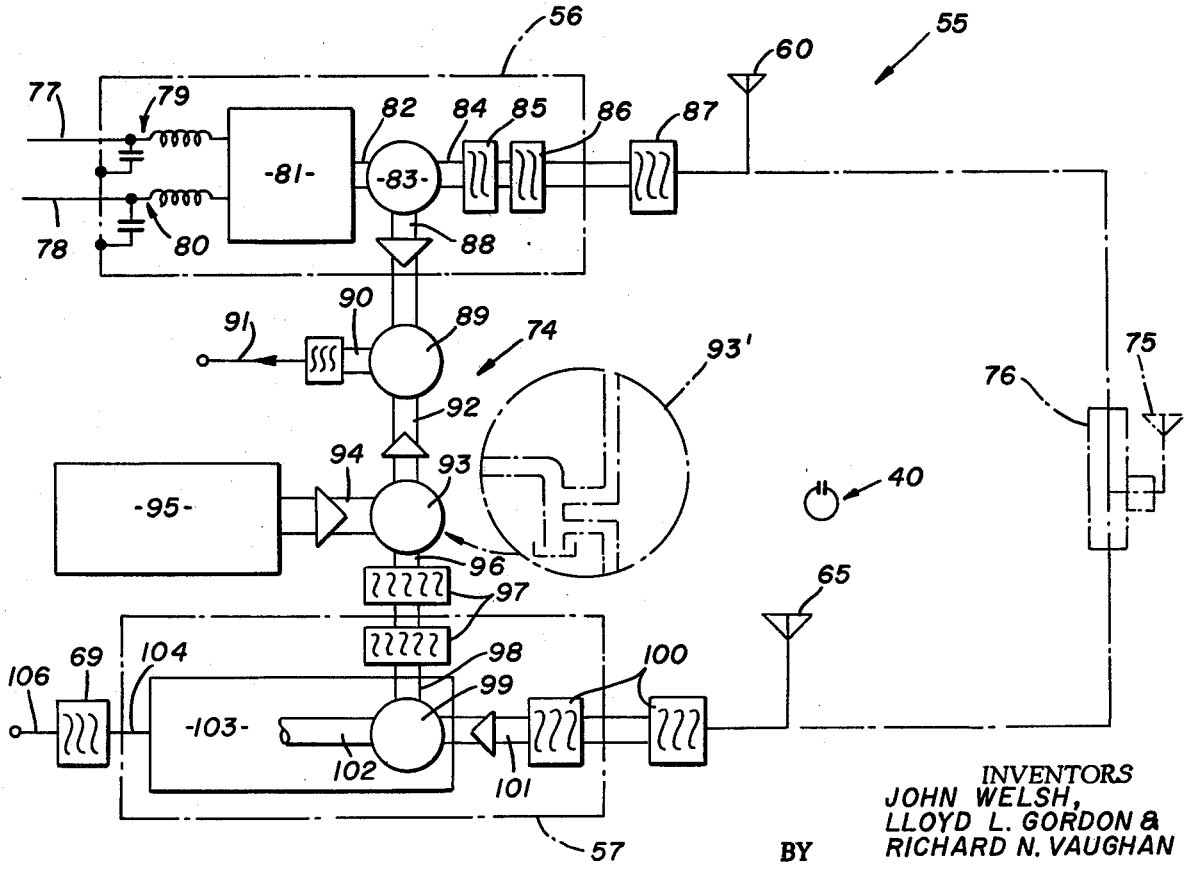
FIG. 4 is a schematic block diagram of a preferred form of microwave frequency transmitter-receiver for detecting other types of sensor-emitters.
Figure 4A:
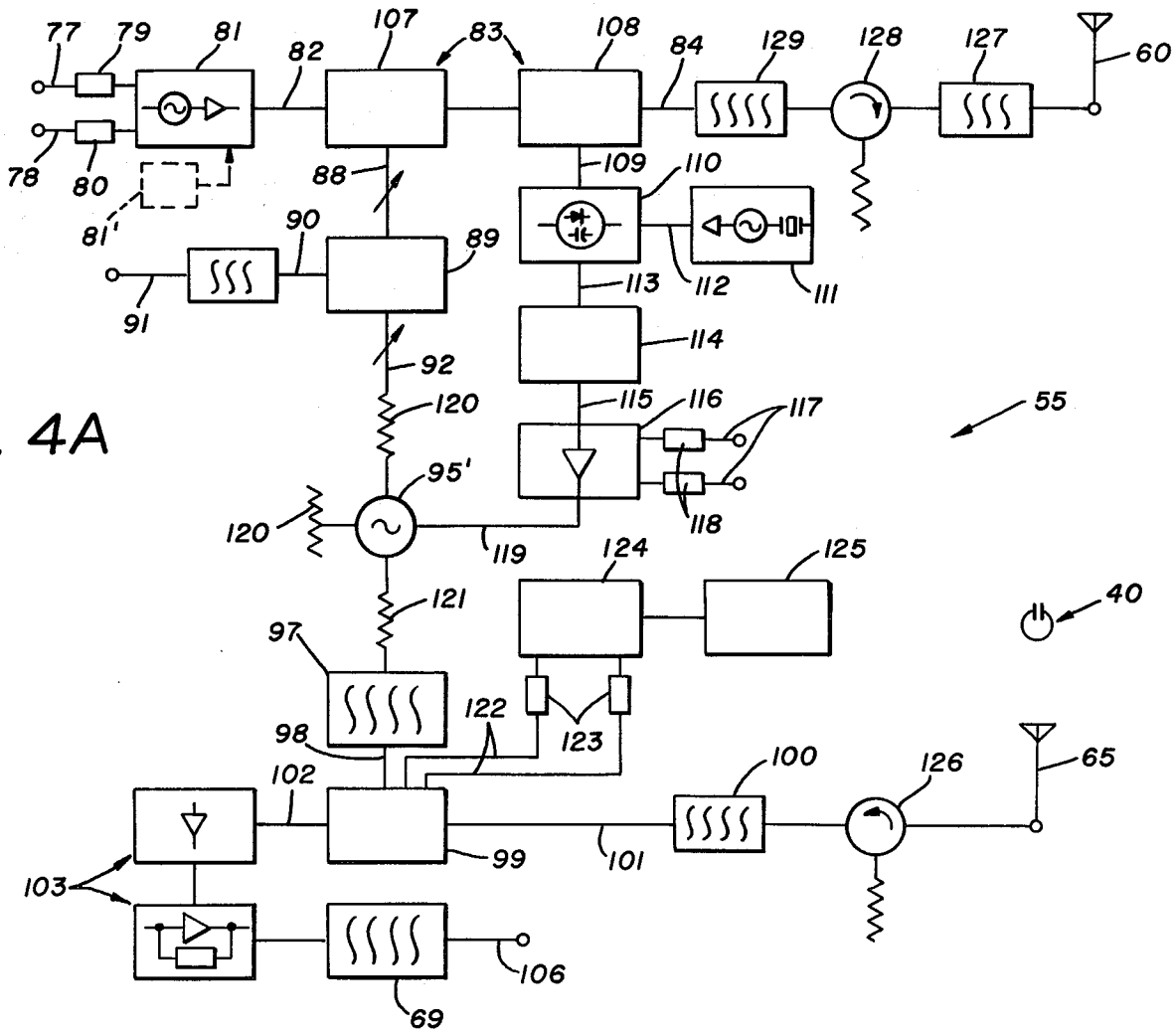
Figure 5:
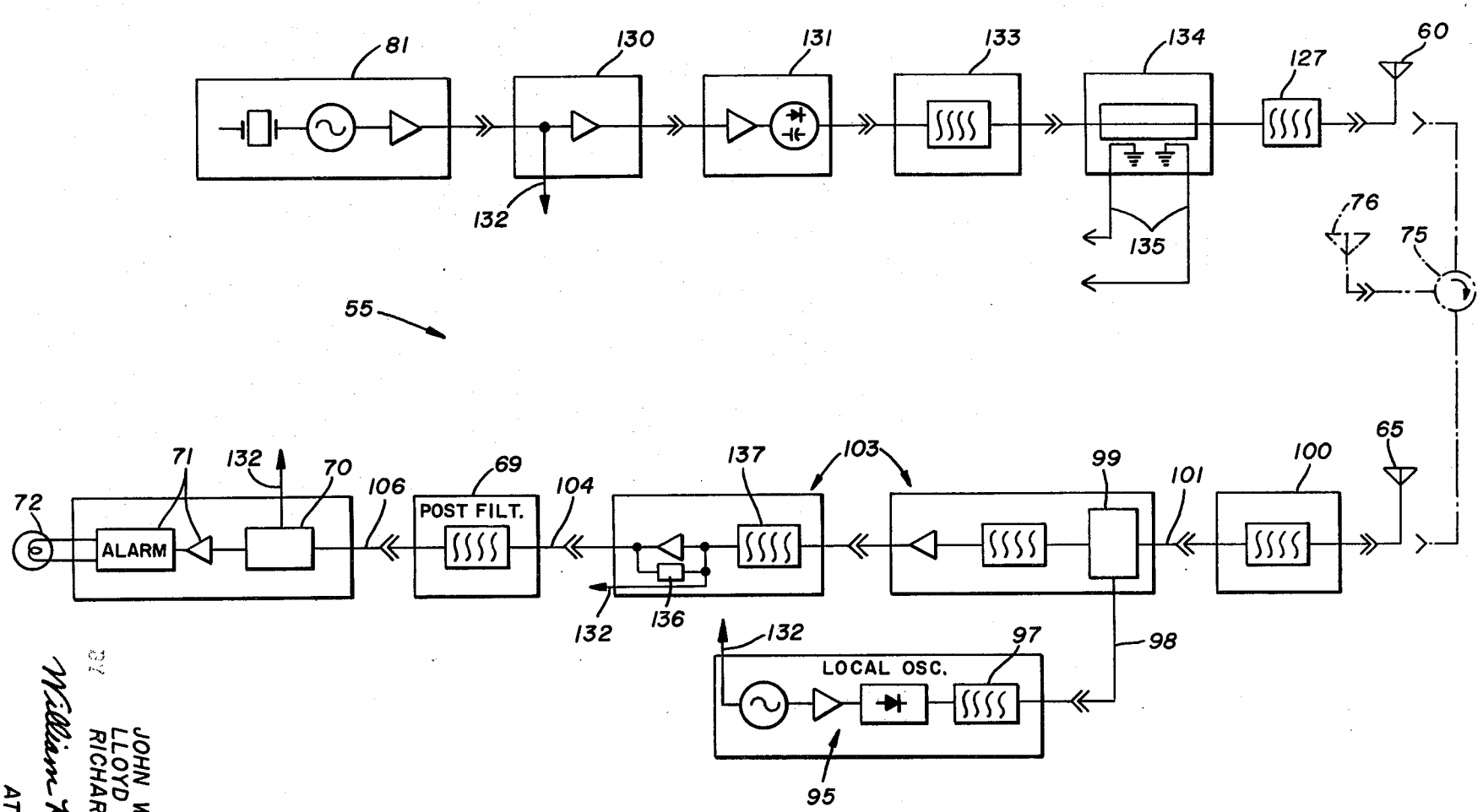
Figure 6:
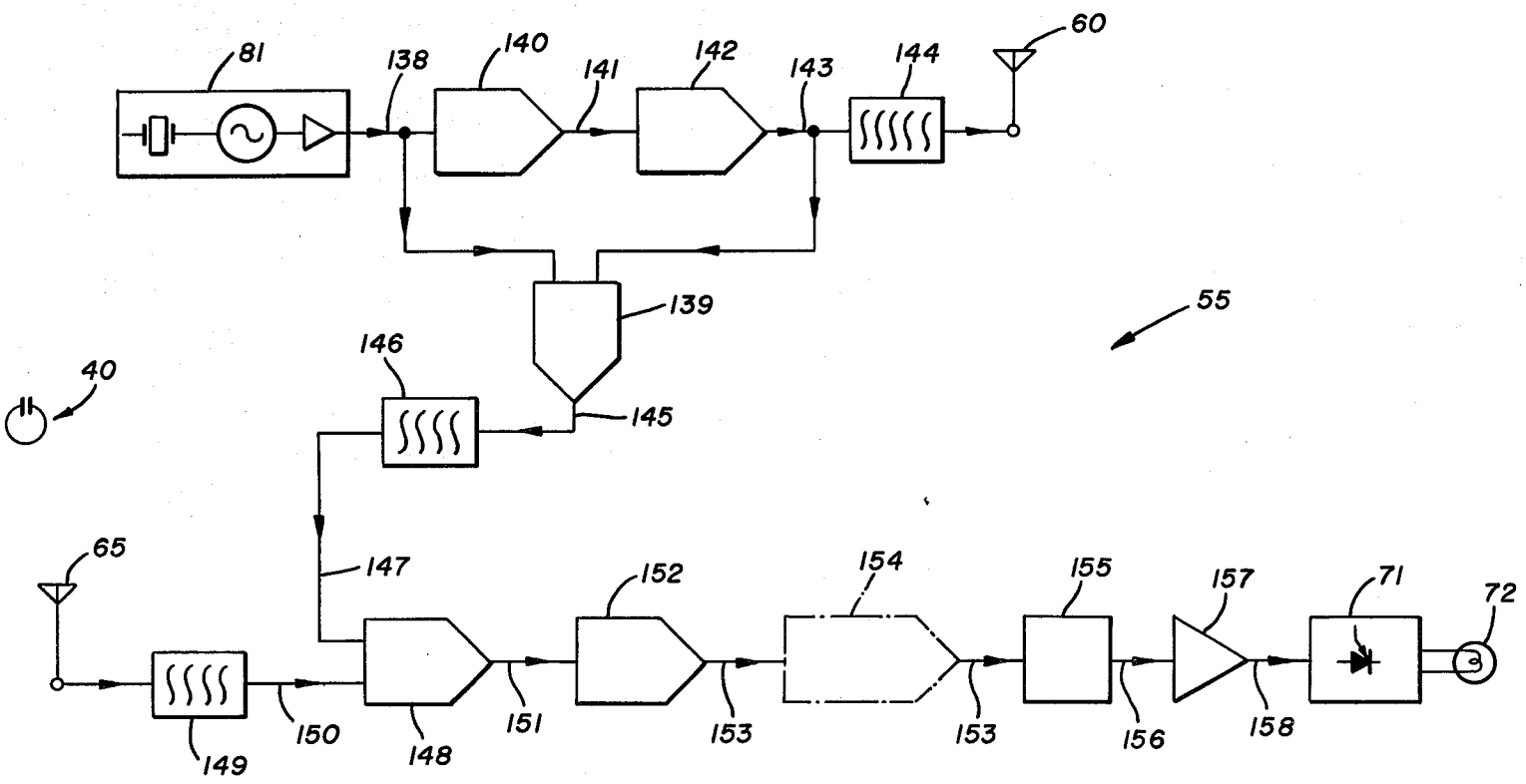
Figure 7:
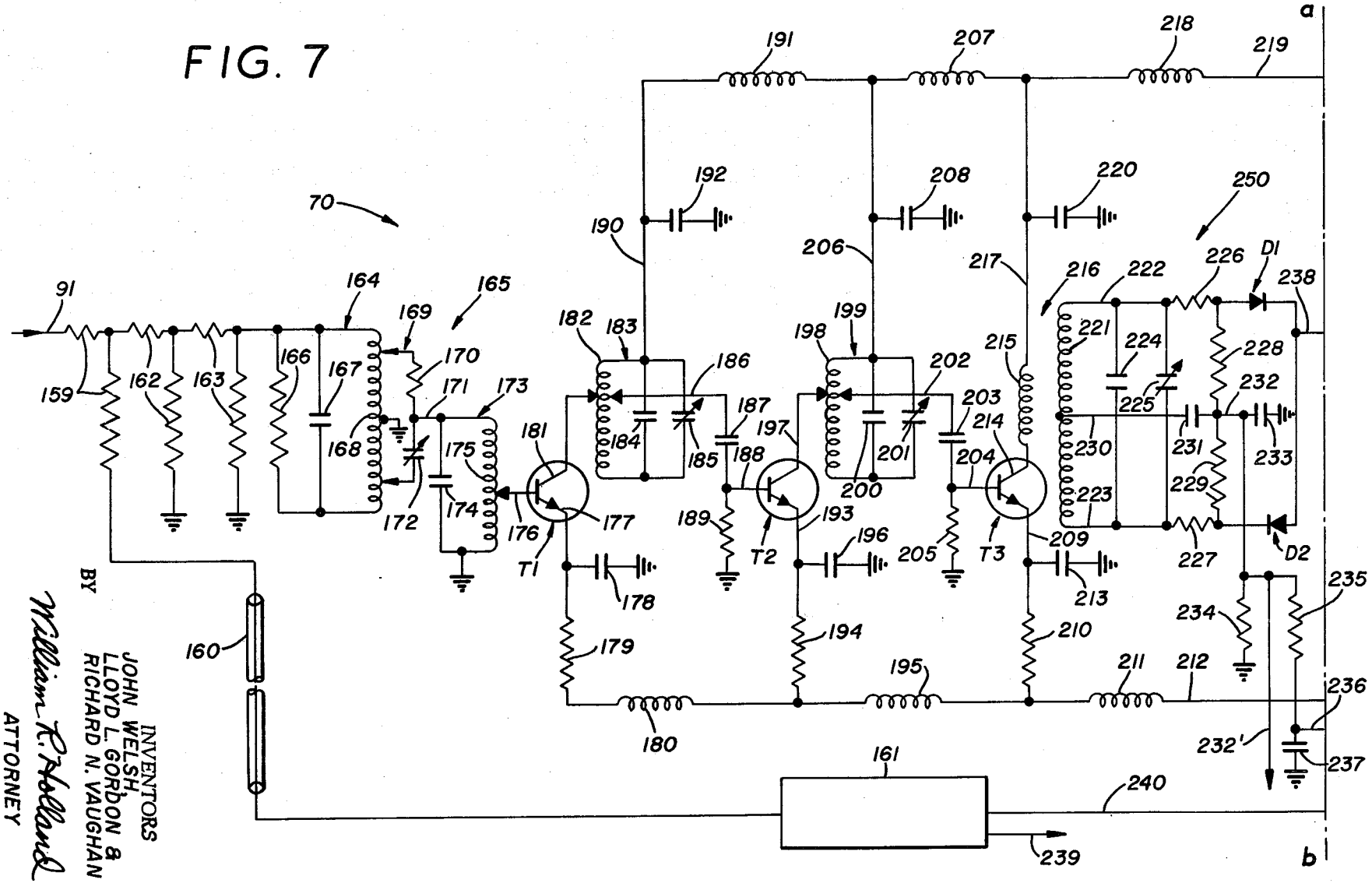

FIG. 4*a* is a more detailed schematic diagram of the microwave transmitter-receiver shown in FIG. 4;

FIG. 5 is a schemiatic block diagram of another form of transmitter-receiver system;

FIG. 6 is a schematic block diagram of yet another form of transmitter-receiver;

FIG. 7 is a schematic circuit wiring diagram of one part of a synchronous or phase-locked detector circuit for the receiver subsystem, bifurcated at chain line *a–b;*

Figures 7A, 7C:
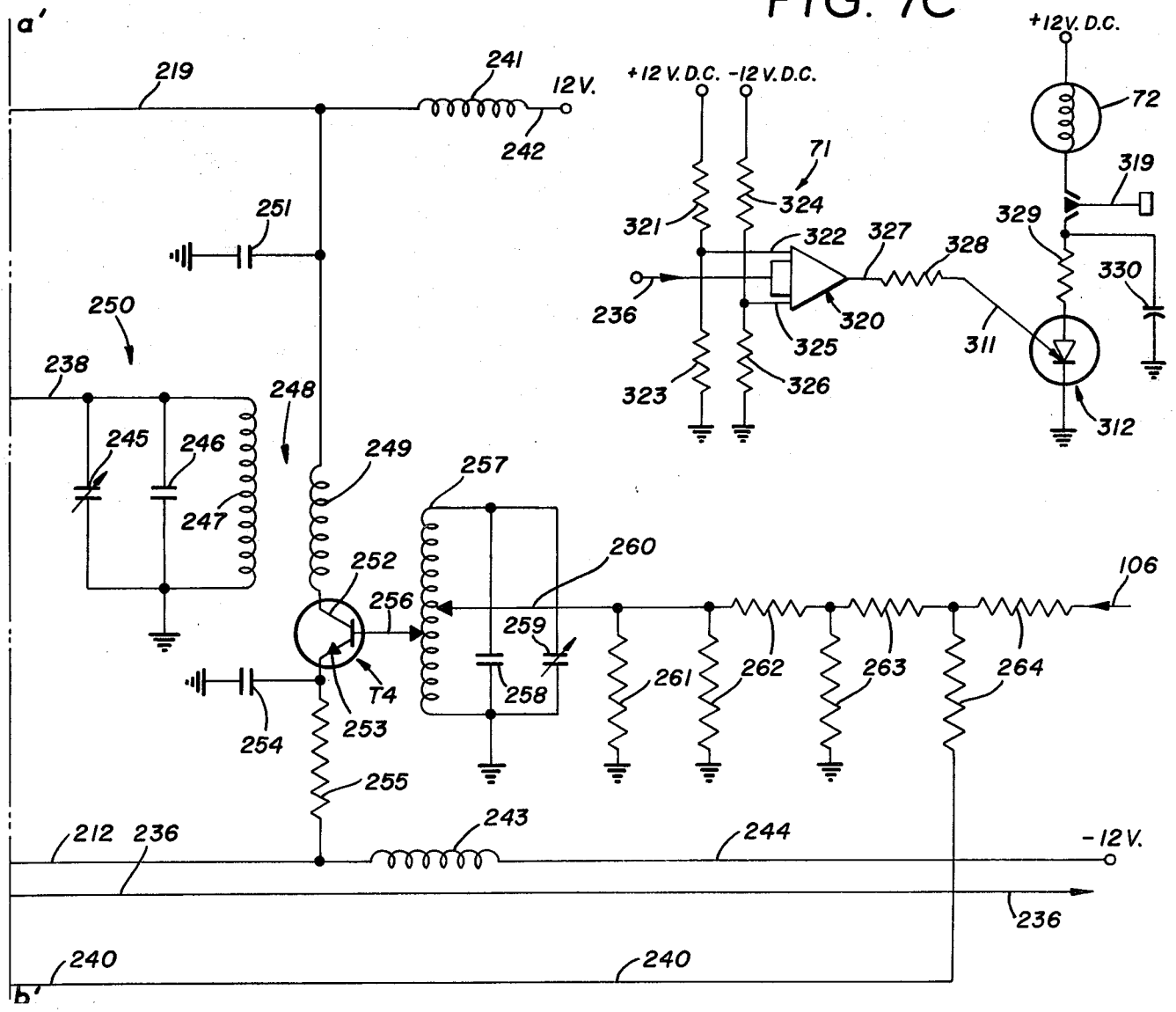

FIG. 7*a* is a continuation of the schematic circuit wiring diagram of FIG. 7, joining thereto at chain line *a'–b';*

Figure 7B:
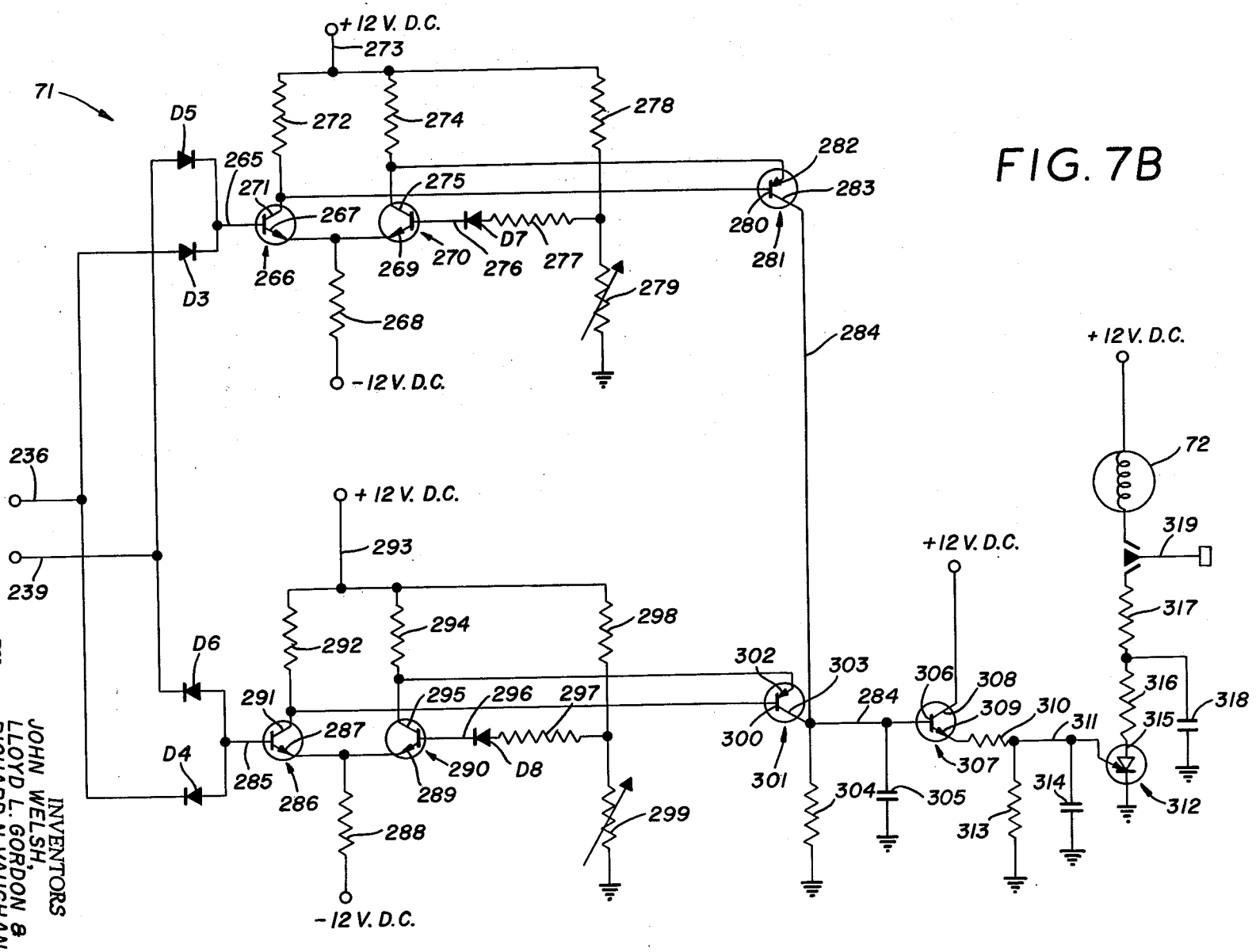

FIG. 7*b* is a schematic circuit wiring diagram of an amplifier and alarm circuit driven by the synchronous detector circuit;

FIG. 7*c* is a schematic circuit wiring diagram of an alternate form of amplifier and alarm circuit to that illustrated in FIG. 7*b;*

Figure 8:
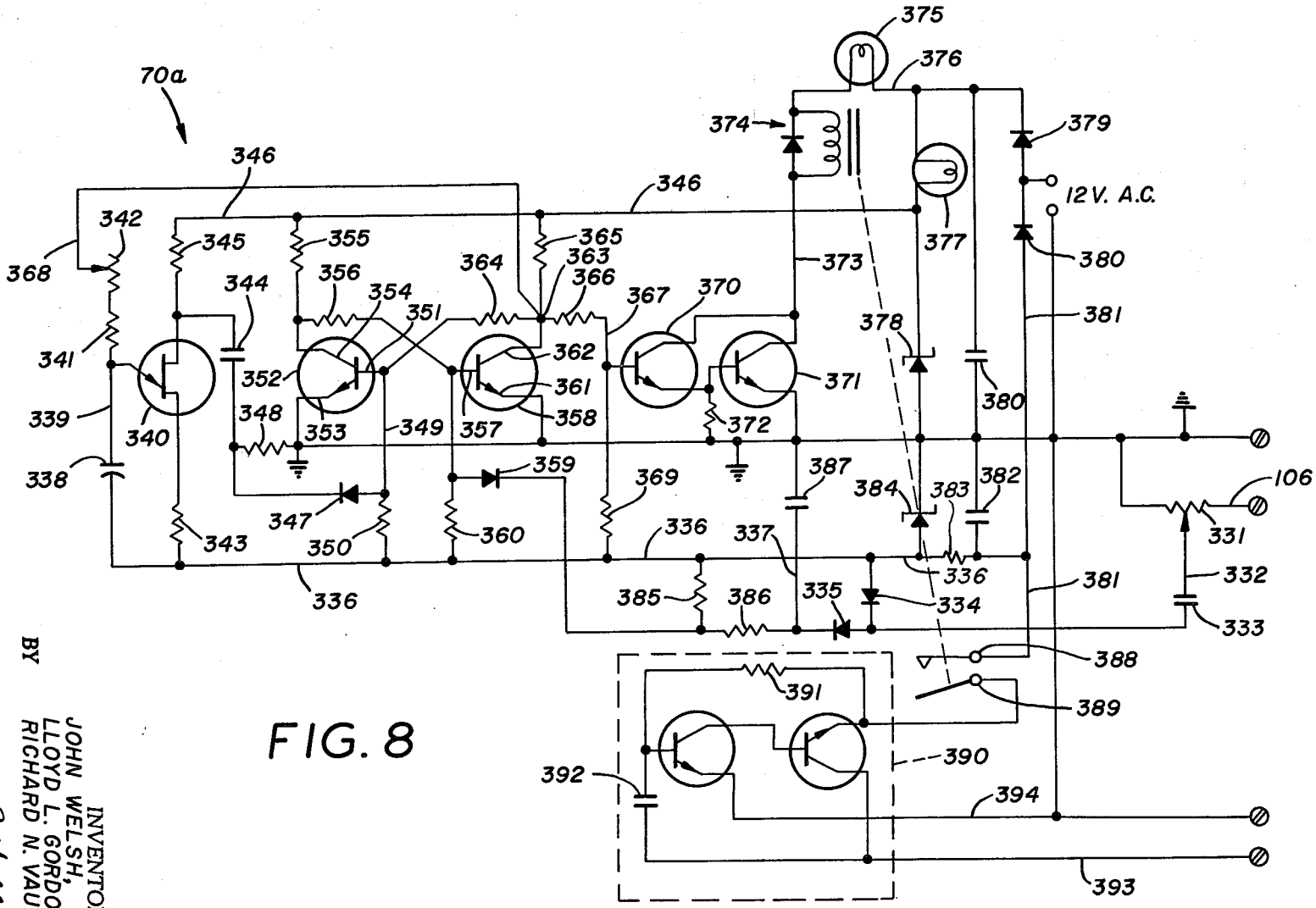
Figure 9:
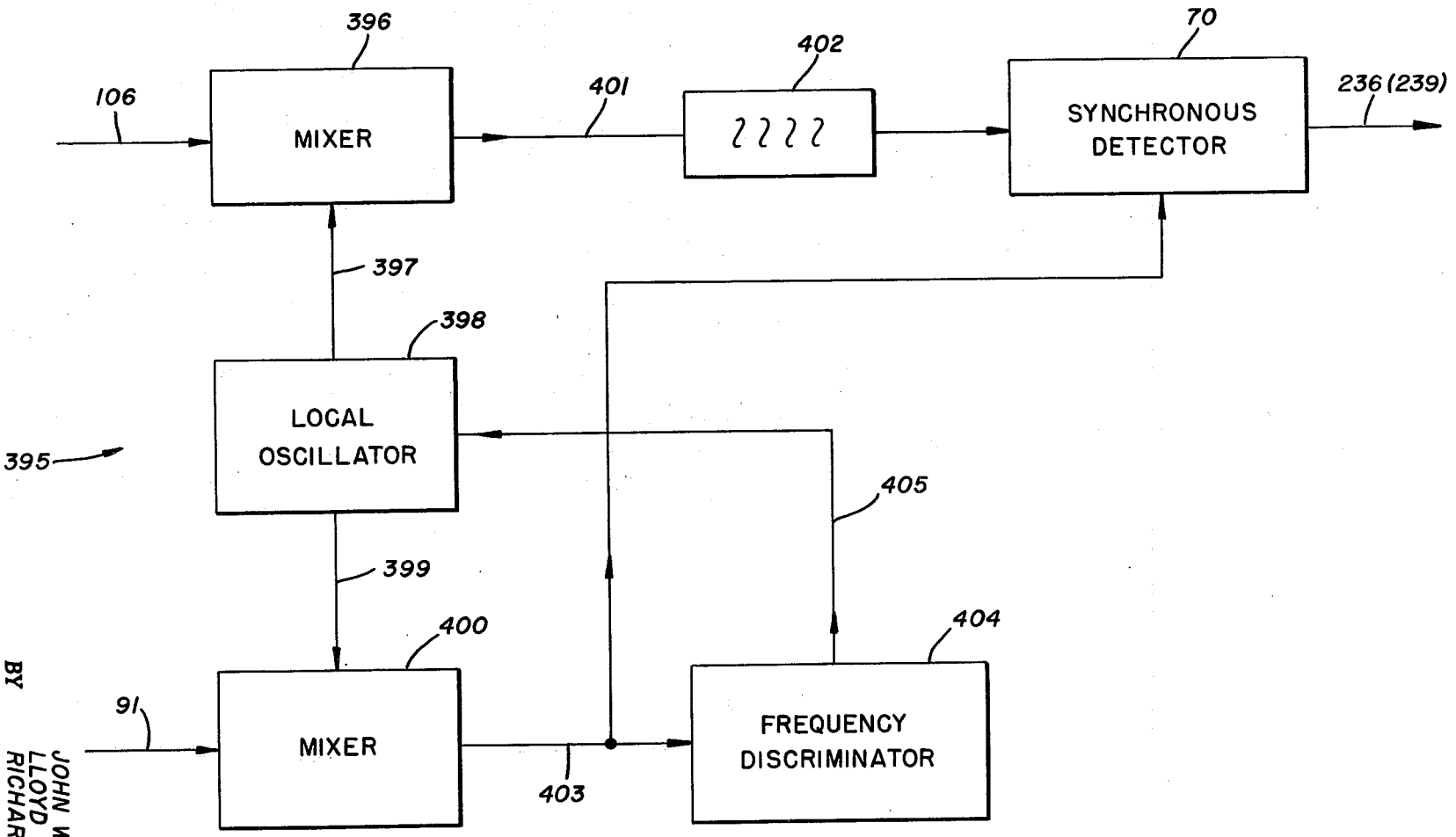
Figure 10:
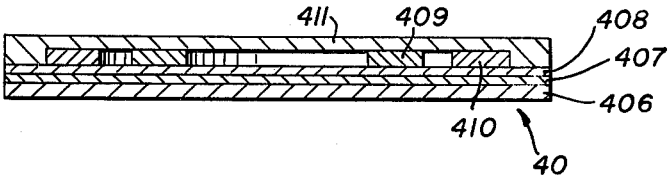
Figure 11:
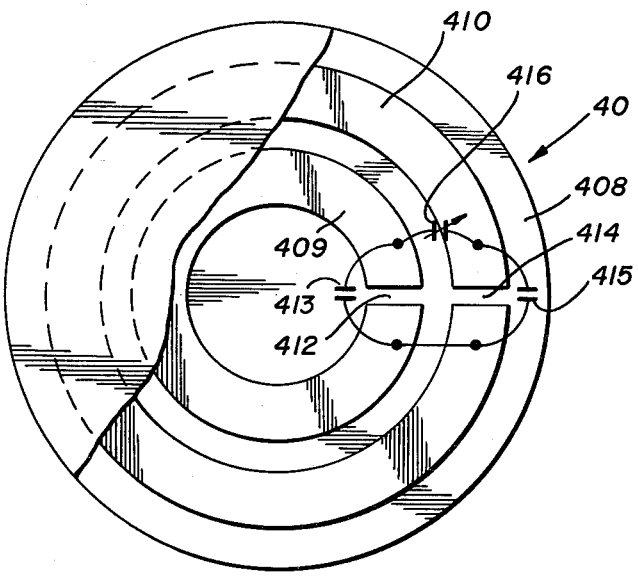
Figure 12:
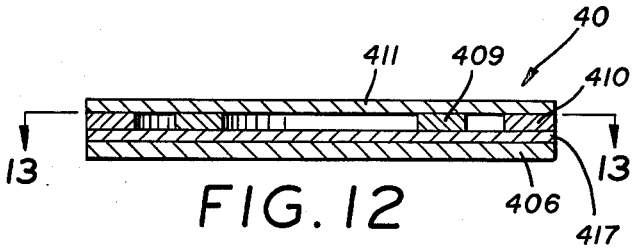
Figure 14:
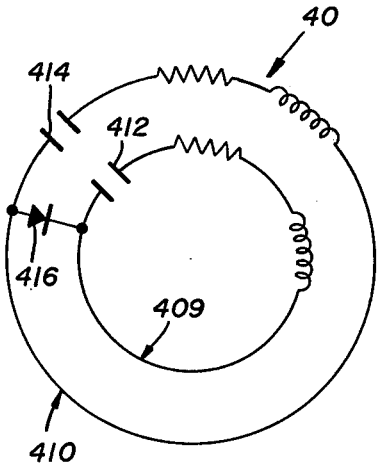
Figure 13:
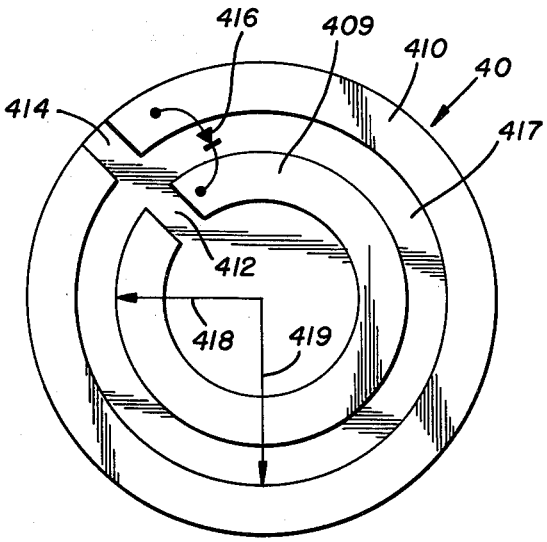
Figure 17:
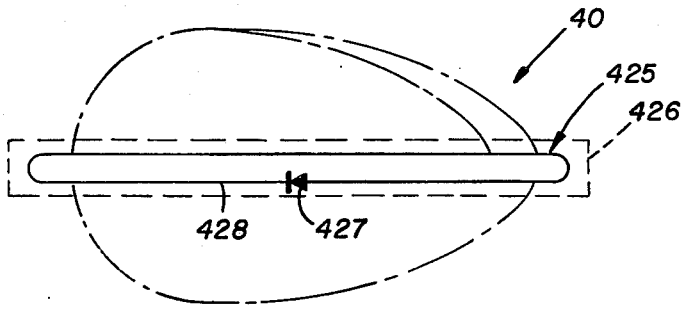
Figure 18:
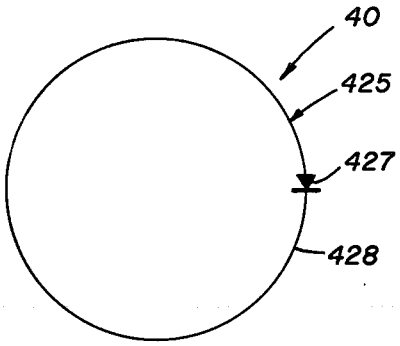
Figure 15:
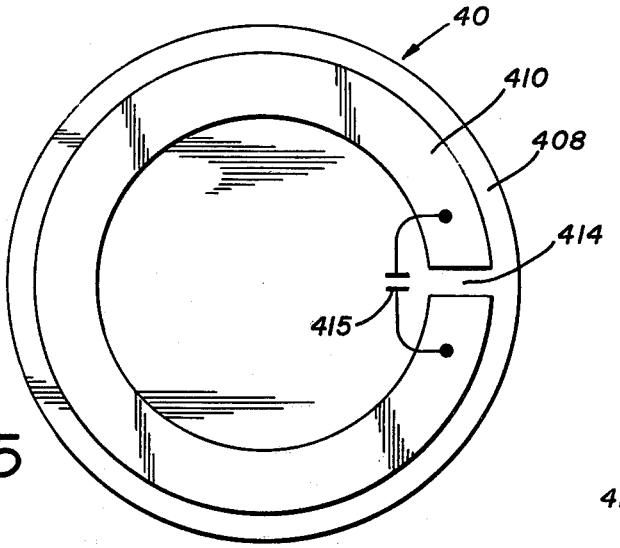
Figure 16:
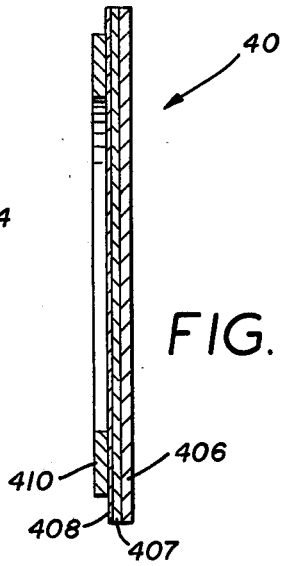
Figure 19:
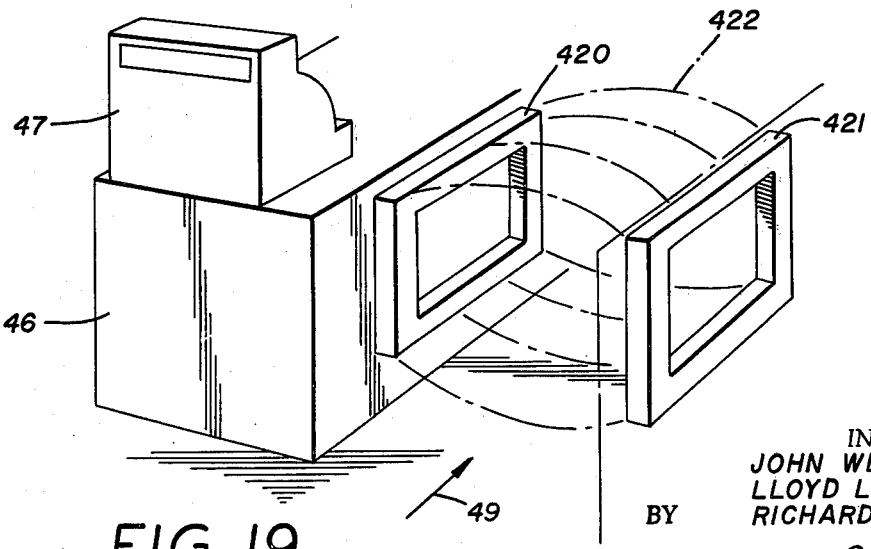
Figure 20:
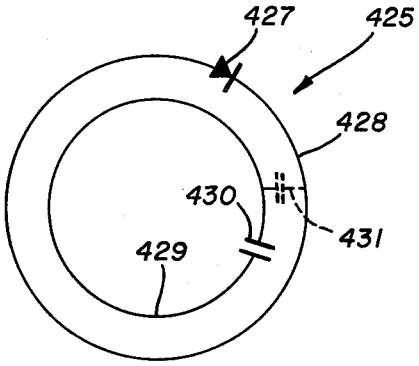
Figure 21:
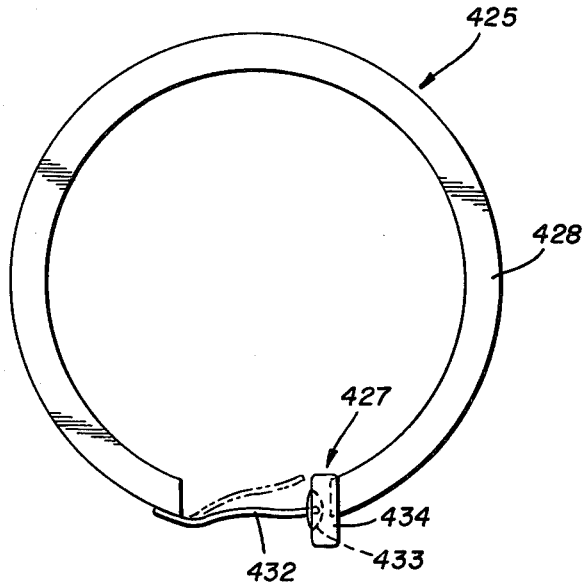
Figure 22:
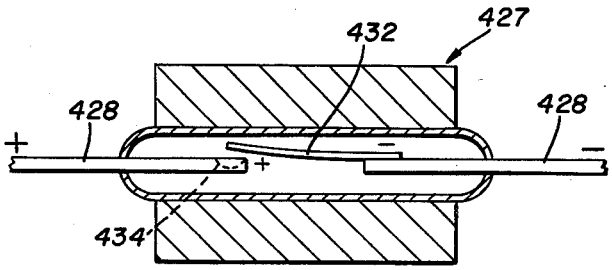
Figure 23:
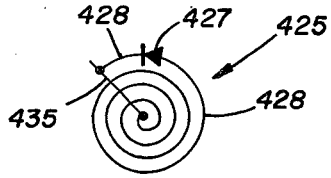
Figure 24:
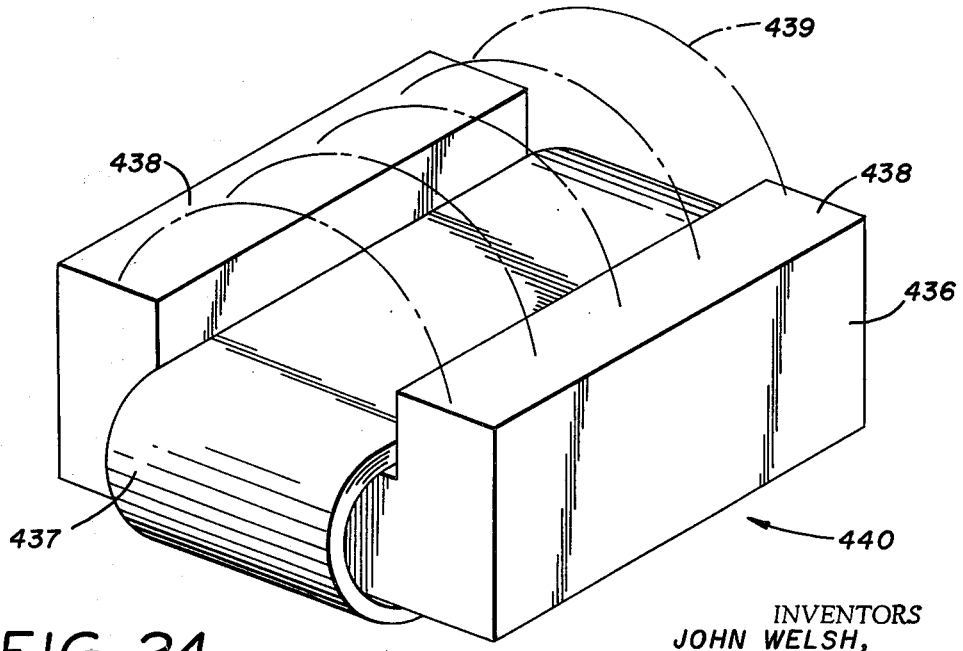
Figure 25:
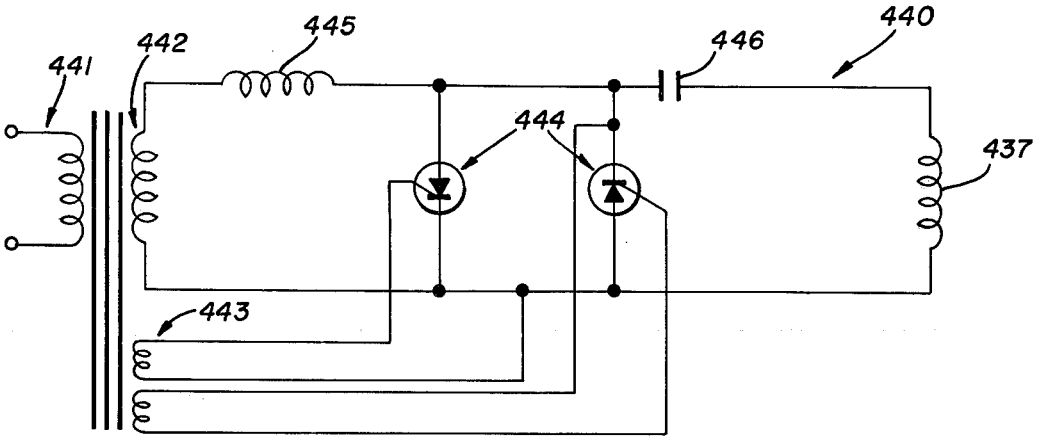
Figure 26:
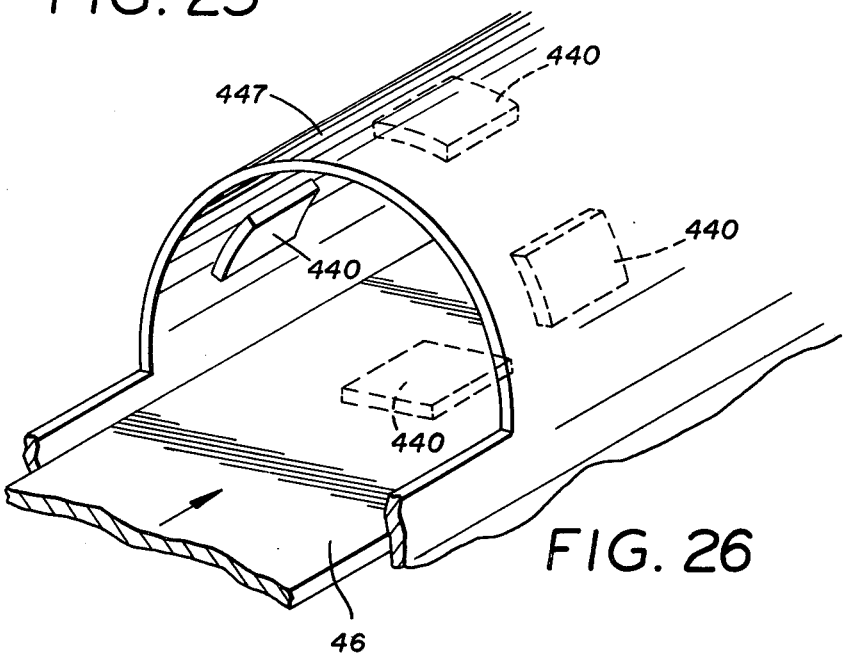
Figure 27:
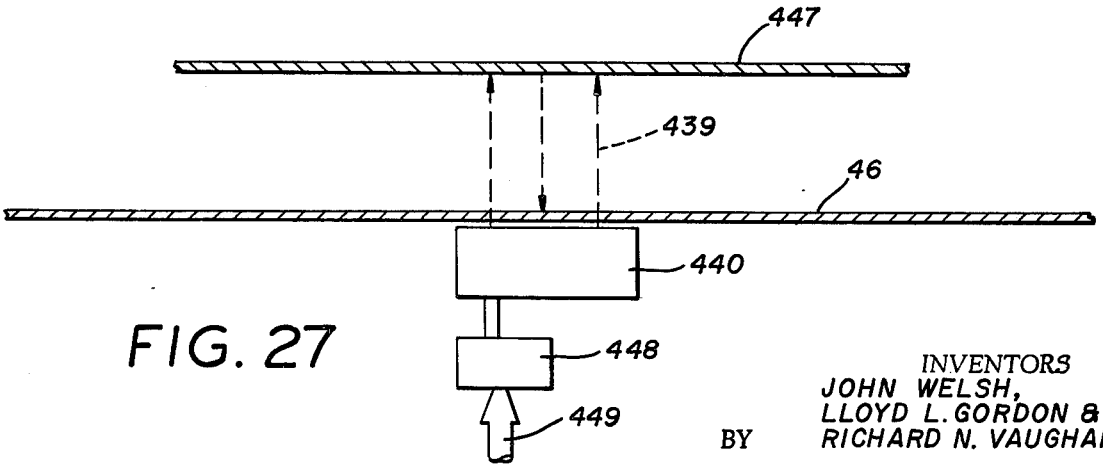
Figure 28:
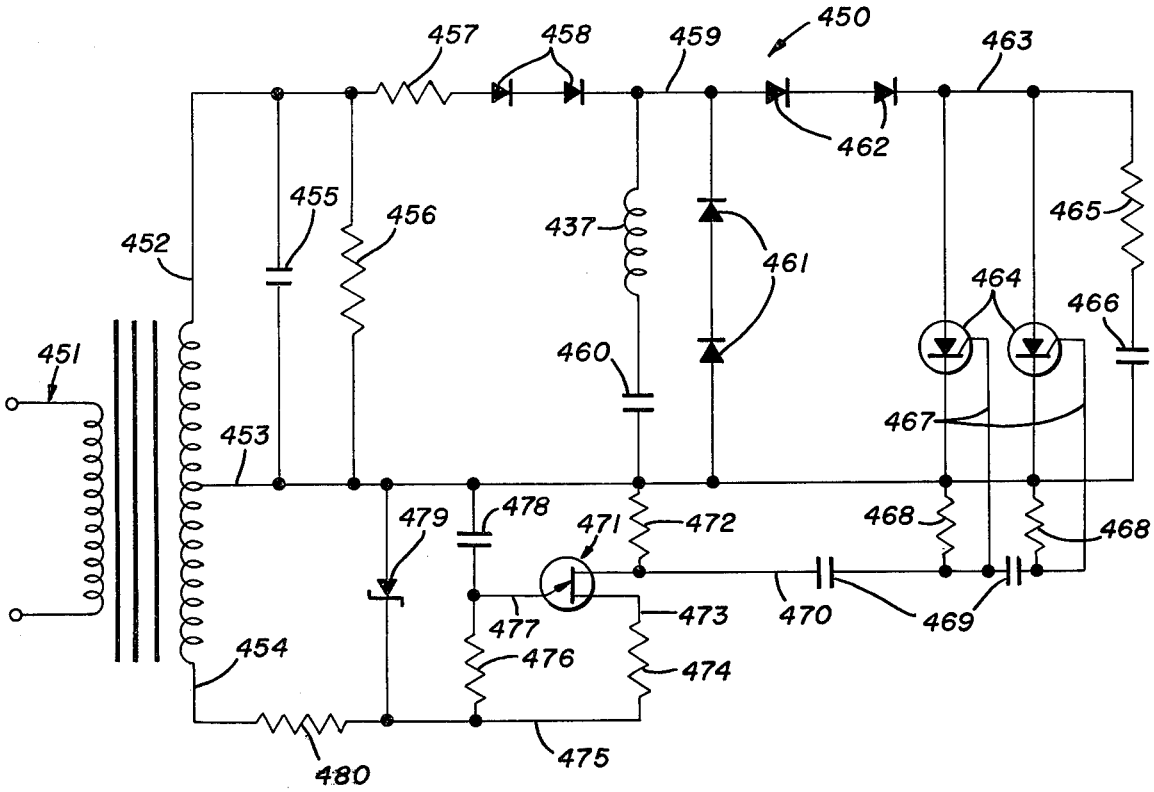
Figure 29:
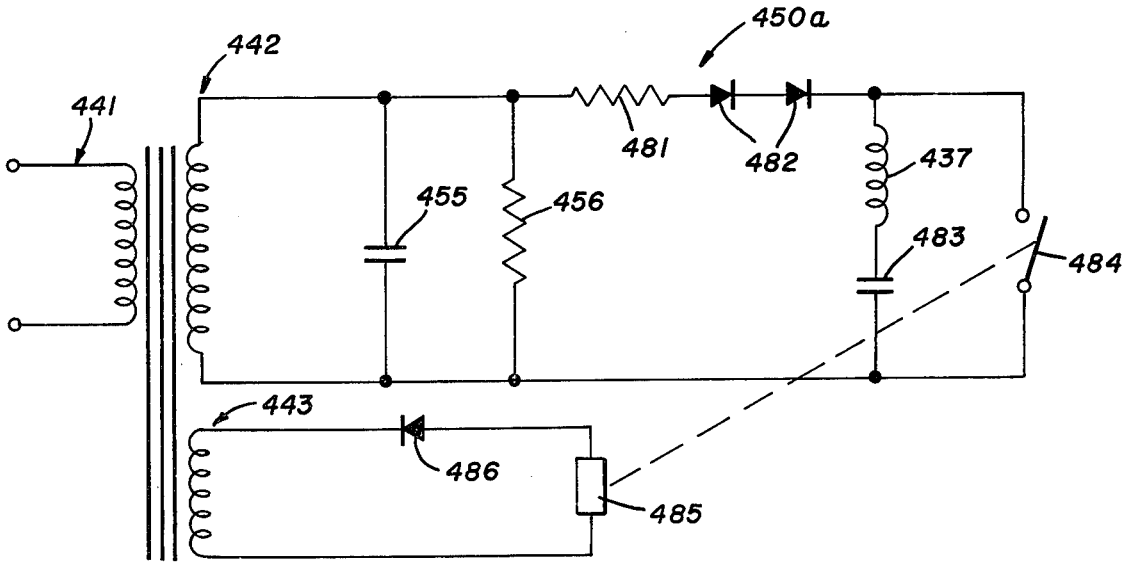
Figure 30:
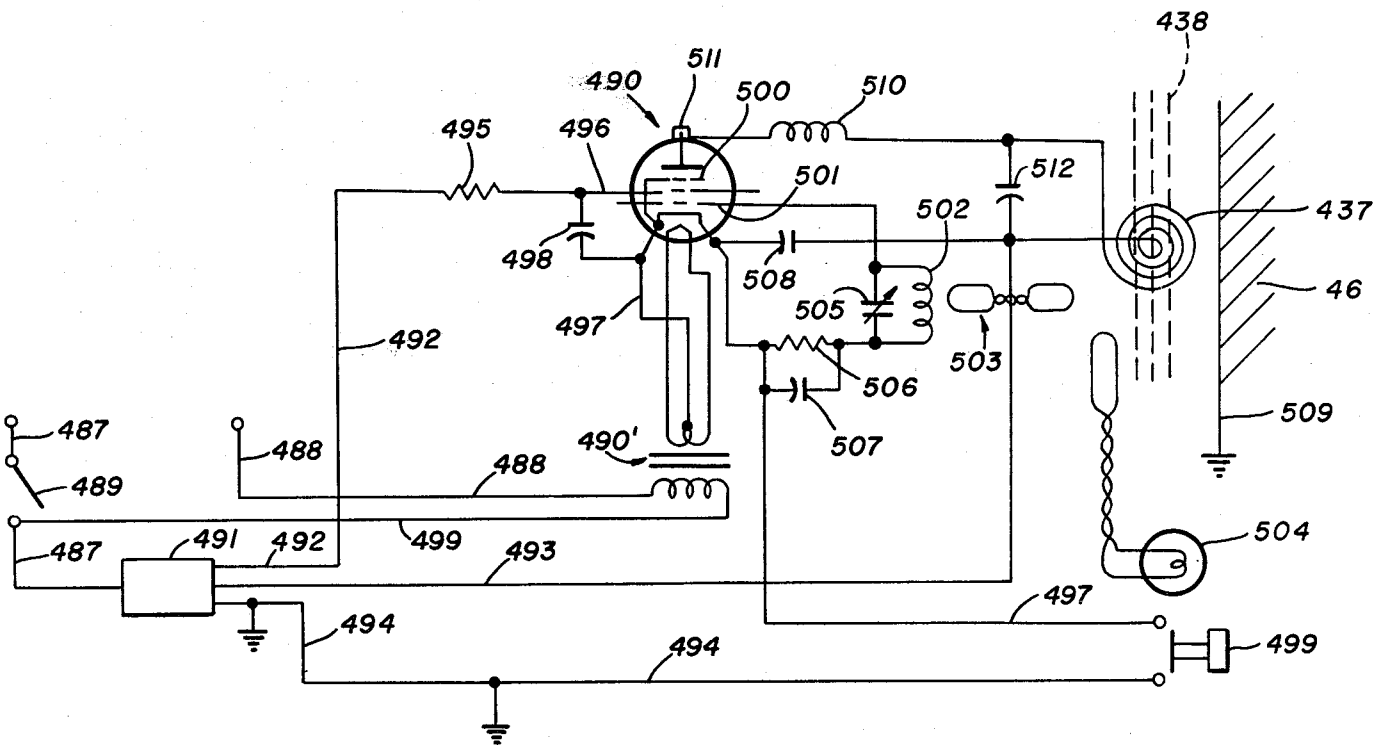
Figure 32:
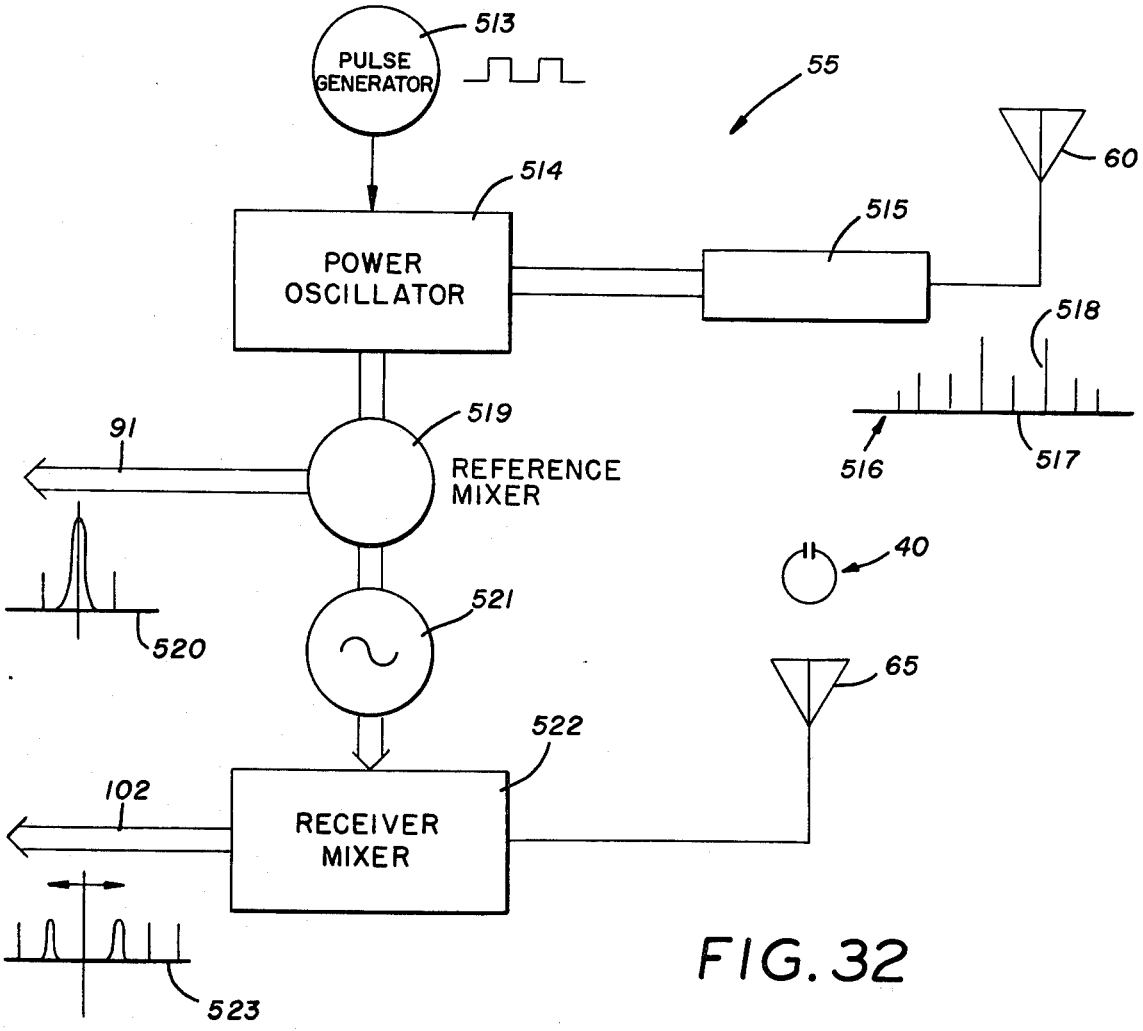
Figure 31:
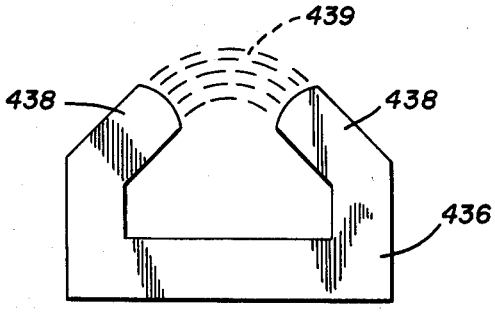

FIG. 8 is a schematic circuit wiring diagram of another form of alarm control;

FIG. 9 is a schematic block diagram of a modified arrangement for the array of input components for the synchronous detector portion of the receiver subsystem;

FIG. 10 is a diametral sectional view of one form of a tuned sensor-emitter;

FIG. 11 is a plan view, partially broken away and partially schematic, of the sensor-emitter of FIG. 10;

FIG. 12 is a diametral sectional view of another form of a tuned sensor-emitter;

FIG. 13 is a transverse top sectional view, partially schematic, of the sensor-emitter of FIG. 12, taken along the line 13—13;

FIG. 14 is a schematic electrical circuit representation of the sensor-emitter of FIG'S. 12 and 13;

FIG. 15 is a top plan view, partially schematic, of one form of a broadly tuned sensor-emitter;

FIG. 16 is a diametral sectional view of the sensor-emitter of FIG. 15;

FIG. 17 is a plan view, partially schematic, of another form of broadly tuned sensor-emitter, in a folded dipole configuration, with patterns or curves of standing electromagnetic waves superimposed thereon in chain lines;

FIG. 18 is a schematic representation of another embodiment of a broadly tuned sensor-emitter;

FIG. 19 is an isometric view of a cashier's checkout counter depicting an arrangement for saturation field coils for activating tuned sensor-emitters not authorized for removal;

FIG. 20 is a schematic representation of another form of broadly tuned sensor-emitter;

FIG. 21 is a plan view of yet another form of sensor-emitter loop with an element thereof being illustrated in chain lines in its deactivated position;

FIG. 22 is a fragmentary sectional view of the junction of a sensor-emitter in its deactivated position;

FIG. 23 is a schematic diagram of a broadly tuned sensor-emitter arranged in a spiral configuration;

FIG. 24 is an isometric view of a sensor-emitter deactivation coil;

FIG. 25 is a schematic circuit wiring diagram for an operating circuit for the deactivation coil of FIG. 24;

FIG. 26 is a fragmentary perspective view of a checkout counter conveyor tunnel arrangement of deactivation units;

FIG. 27 is a vertical sectional view of another embodiment of checkout deactivation unit utilizing a reflector shield arrangement;

FIG. 28 is a schematic wiring diagram of another operating circuit for the deactivation coil of FIG. 24;

FIG. 29 is a schematic wiring diagram of yet another form of operating circuitry for the deactivation coil of FIG. 24;

FIG. 30 is a schematic and functional wiring diagram for another form of deactivation unit;

FIG. 31 is an end view of a deactivation coil core illustrating pole-shaping modifications for increasing the depth or intensity of the deactivation field; and FIG. 32 is a schematic block diagram of another variation of a transmitter-receiver system employing modulation techniques.

While the methods, devices, and systems described herein in detail are particularly adapted to theft detection in retail stores, it will be appreciated by those skilled in the art that the principles of the invention may be applied with equal facility and feasibility to other article surveillance problems in general, including warehousing and inventory control and dispatching, identification of personnel and vehicles, control of processing and quality, control of materials handling equipment and systems, monitoring and operation of telemetry and remote control systems, and many other applications.

In general, the invention pertains to article surveillance techniques wherein electromagnetic waves are transmitted into an area of the premises being protected at a fundamental frequency, and the unauthorized presence of articles in the area is sensed by reception and detection, as by means of the novel synchronous detection circuitry disclosed, of second harmonic or subsequent harmonic frequency waves reradiated from sensor-emitter elements, labels, or films attached to or embedded in the articles, under circumstances in which the labels or films have not been deactivated for authorized removal from the premises.

Figure 1:
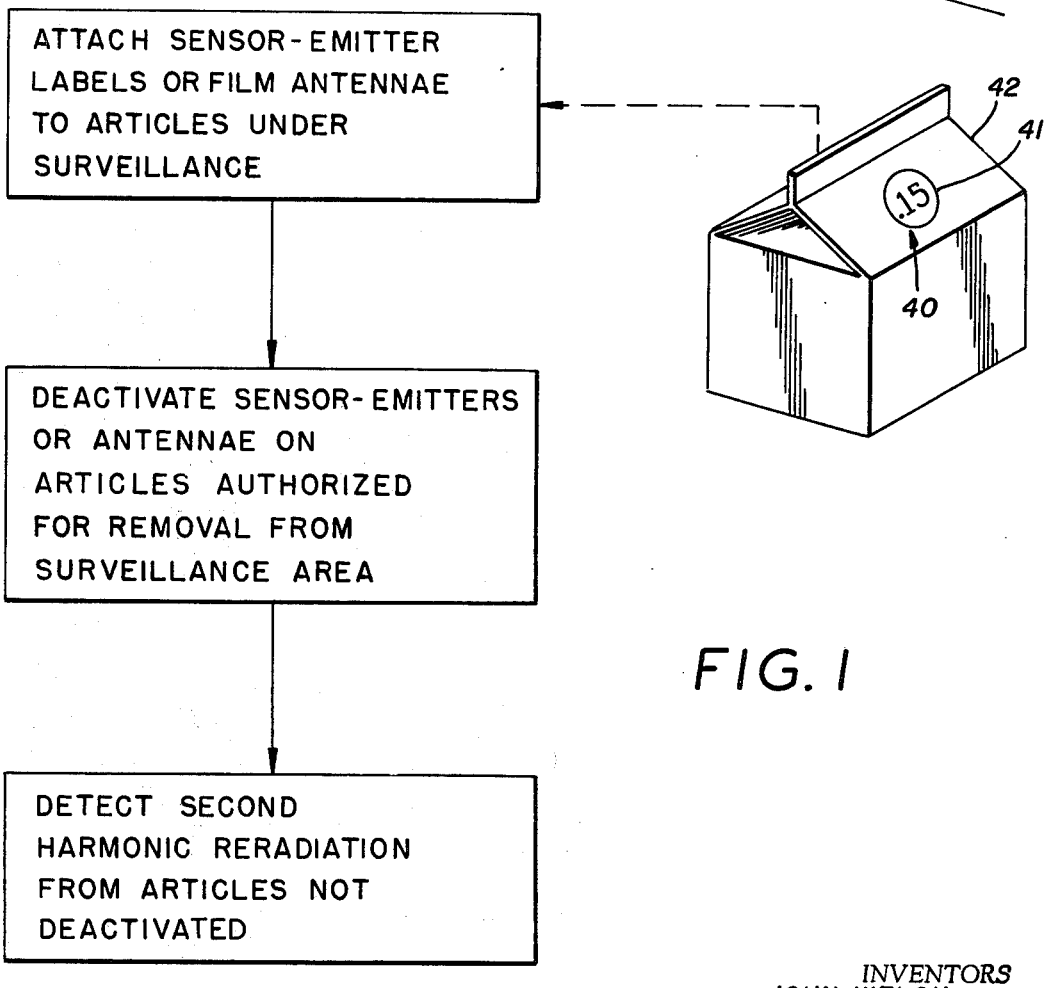
FIG. 1 is a schematic block diagram illustrating the sequential method steps or operations in a preferred form of the method of article surveillance according to the present invention.

Referring to FIG. 1, a method of article surveillance or theft detection according to one preferred form of the invention may be understood by reference to the block diagram illustrating the sequential steps utilized. A film antenna sensor-emitter element 40, as for example formed integrally with price label 41, is attached to or embedded in an article or object, such as carton 42, which is under system surveillance. Next, sensor-emitter elements 40 on articles 42, which have been paid for or otherwise authorized for removal from the surveillance area, are deactivated or desensitized by a checkout clerk or guard monitoring the premises. Thereafter, second harmonic frequency reradiation signals or reradiating electromagnetic waves or electrical space energy from sensor-emitters 40, which have not been deactivated or desensitized, are detected as they are moved through an exit or verification area in which a fundamental frequency electromagnetic wave or electrical space energy field is present. The detection of second harmonic signals in this area signifies the unauthorized presence or attempted removal of unverified articles 42, with active elements 40 thereon, and may be used to signal or trigger an alarm or to lock exit doors or turnstiles. While the detection of second harmonic signals represents a preferred form of the method, it will be appreciated from the present disclosure that third and subsequent harmonic signals, as well as fundamental and subharmonic signals, may be employed.

Although the sensor-emitter element 40 preferably constitutes an unobtrusive and integral part of a conventional price label 41 and is laminated therein for adhesion attachment to the article 42, one or more elements 40 may be imbedded or incorporated in the packaging for the article or in the article itself.

Figure 2:
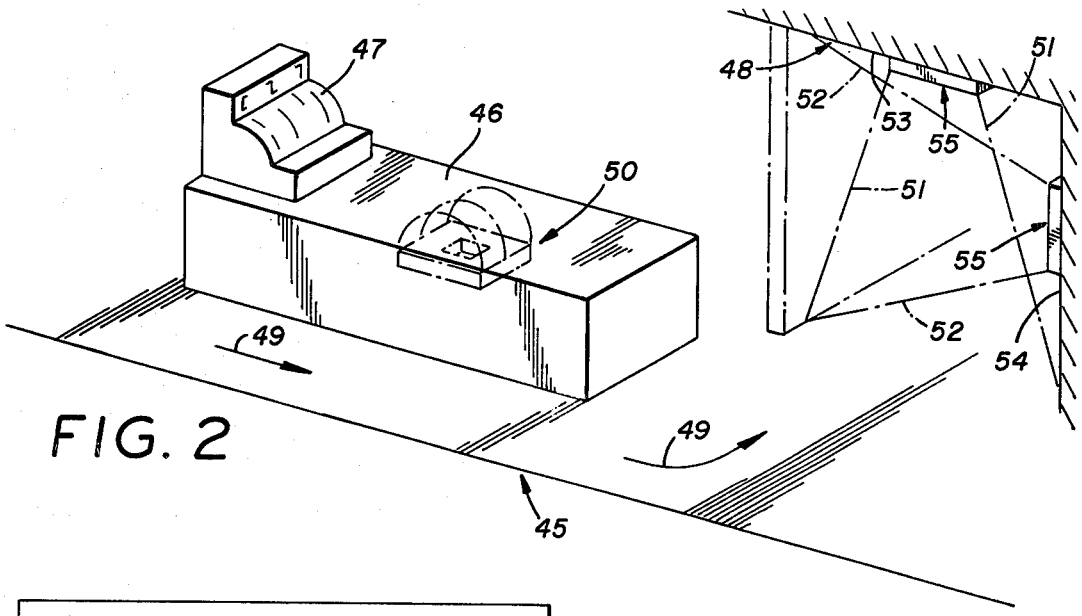
FIG. 2 is an isometric view of a cashier's checkout counter for a retail self-service store and its associated exit, depicting a typical or exemplary arrangement of subsystems or component units of such an article surveillance system arrayed for shoplifting detection.

FIG. 2 illustrates one general arrangement of the system, designated generally by the numeral 45, for a self-service retail store having one or more checkout counters 46 and associated cash registers 47 and exit areas 48. A patron leaving the store follows the path indicated by arrows 49. Sensor-emitters 40 on any articles which have been paid for and thus authorized for removal from the premises are deactivated or desensitized by one or more intermittently operable deactivator subsystems or units, designated generally by the numeral 50, which may be selectively actuated manually by the cashier on duty at counter 46 or automatically by the cash register 47.

A vertically oriented electromagnetic wave or electrical space energy field, delineated generally by chain lines 51, and, if desired, a supplemental transversely or horizontally oriented field, delineated generally by chain lines 52, are established at the passageway 48 by location or mounting at the transom 53 and a portal 54 of one or more transmitter-receiver subsystems or units, designated generally by the numeral 55. Portals 54 may be shielded, if desired, with plates or grids of aluminum or other suitable wave reflecting material to confine reverberations or spurious emanations in installations with multiple exits or entrances within adjacent or close proximity.

The transmitter receiver units 55, hereinafter described in detail, when equipped with transmitting antennae producing field patterns 51 and 52 having a half-cone angle of 10° to 20°, have been found capable of satisfactorily transmitting and receiving or detecting second harmonic reradiated signals from sensor-emitter elements 40 at distances up to several hundred yards with only relatively low power input requirements.

Figure 3:
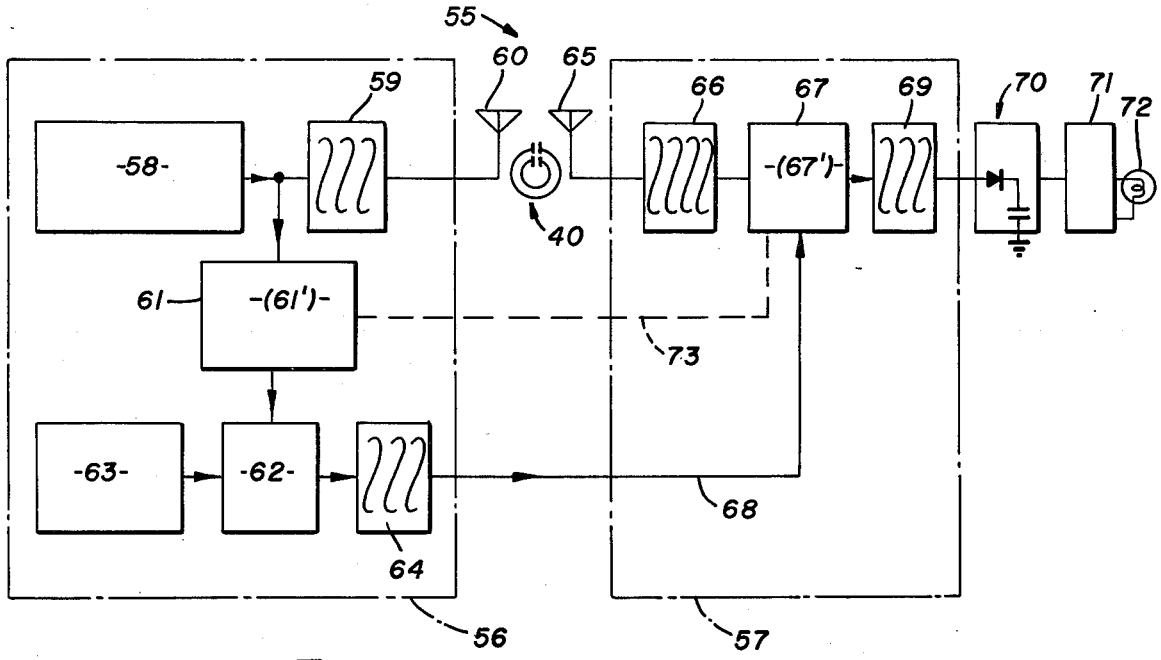
FIG. 3 is a schematic block diagram of a radio frequency embodiment of a transmitter-receiver system for detecting sensor-emitters of a tuned-loop type.

Referring now to the system block diagram of FIG. 3, one embodiment of a transmitter-receiver subsystem or unit 55 basically consists of a fundamental frequency transmitter section and a second harmonic frequency receiver section, as generally designated and delimited by chain lines 56 and 57, respectively.

The fundamental frequency transmitter section 56 may consist of a power or transmitter oscillator 58, preferably crystal-controlled, connected through a narrow band transmitter antenna filter 59 to transmitter antenna 60 and through a second harmonic generator 61 to a mixer 62 into which a signal from a reference signal oscillator 63 is fed to send a reference signal through a narrow band connector filter 64 to the second harmonic frequency receiver section 57.

In actual embodiments of the transmitter section 56, a crystal-controlled power oscillator 58 with 20 to 50 watts, and as small as fractions of a watt, variable power output at 100 mega-Hertz or megacycles per second has been employed with a 100 megacycles per second transmitter antenna filter 59, a 1000 cycles per second reference signal oscillator 63, a 200 megacycles per second generator 61, and a 200.001 megacycles per second connector filter 64. Power oscillator 58 may be varied in frequency if desired, over a range of between 80 and 120 and up to 250 megacycles per second, but the preferred basic transmitter frequency for the system of FIG. 3 is 100 megacycles per second.

As an alternate form of the system of FIG. 3, a crystal or piezoelectric controlled local oscillator 61 producing a five megacycles per second signal may be substituted for generator 61; and the power oscillator 58 may be set for establishment of a 95 megacycles per second output. In this case, the power oscillator 58 is connected, through a suitable mixer (not shown), also coupled to the crystal oscillator 61, to the transmitter antenna filter 59; and a suitable series combination of first a 100 megacycles per second filter and then a radio-frequency power amplifier (not shown) is interposed ahead of the transmitter antenna filter 59. The connector filter 64 used in this arrangement is a 5.001 megacycles per second crystal filter. In this alternate form of transmitter section 56, a second signal connection (indicated in dashed lines in FIG. 3) is made with the receiver section 57.

Various forms of transmitter antennae 60 may be employed, including ordinary or folded dipoles, logarithmic or Archimedes spirals, and axial helical configurations, among others. Parabolic, coaxial, and cage reflectors or shields and suitable adjustable attenuators may also be utilized in conjunction with antennae 60 in environments or applications requiring limited, intensified, or confined transmitter radiation field patterns or gradients.

The second harmonic frequency receiver section 57, in a preferred actual embodiment, is composed of a receiver antenna 65 which may be mounted in relatively close proximity or juxtaposition with the transmitter 60 in a transmitter-receiver type 55. Receiver antennae 65 may be of the same or similar types and configurations, and may be provided with the same or similar accessories, discussed above with relation to transmitter antennae 60, depending again upon installation and operation criteria of variant environments and applications.

Receiver antenna 65 receives harmonic frequency reradiated signals produced by the induced voltage and conduction and displacement currents created in sensor-emitter elements 40 by the impingement of fundamental frequency transmission field signals or waves from transmitter antennae 60, in a manner hereinafter more fully explained in connection with the detailed disclosure of tuned loop elements 40. The receiver antenna 65 and receiver section 57 are preferably adapted to detect second harmonic reradiated signals from elements 40; although it has been found third and fourth harmonic reradiated signals of sufficient magnitude may be produced. Moreover, where desired, sensor-emitter elements 40 and transmitter-receiver units 55 may be suitably and conveniently modified for system receiver and detection operation at subsequent harmonic and subharmonic frequencies with respect to the fundamental frequency of transmission.

Receiver antenna 65 feeds the second harmonic reradiated signal, for example 200 megacycles per second, through a narrow band receiver antenna filter passing the second harmonic (e.g., 200 megacycles per second) to a mixer 67. A reference signal 68, such as 200.001 megacycles per second from mixer filter 64, is conducted to mixer 67 from transmitter section 56. The output of mixer 67 is filtered through a narrow band width detector filter 69 to a detector, designated generally by the numeral 70. With a reference signal of 200.001 megacycles per second, and a receiver signal of 200 megacycles, detector filter 69 should be chosen to pass 1000 cycles with a band width of plus or minus ten cycles to mitigate noise factors and reduce power requirements. For such a receiver section 57 operating at 200 megacycles, detector 70 detects 1000 cycles per second signals, representing the difference between the 200.001 megacycle reference signal 68 and any reradiated 200 megacycle second harmonic signal from sensor-emitter elements 40 received by antenna 65 and passed through receiver filter 66 to mixer 67. The detection signal thus produced in detector 70 energizes or actuates an amplifier 71, such as a d.c. amplifier, to actuate or trigger a suitable alarm, as for example lamp 72.

In the system using a 200.001 megacycle reference signal 68 as just discussed, it may be necessary, in certain instances, to incorporate additional sum-and-difference frequency filters following connector filter 64 to filter out undesired image and other extraneous freqency signals such as 199.999 megacycles. System frequency drift from power oscillator 58, if any, may be cancelled or nullified by employing a detector 70 utilizing novel synchronous or phase-locked detection circuitry as hereinafter dislosed in detail. Moreover, any drift from the power oscillator 58 or reference oscillator 63 (or local oscillator 61') may be minimized or alleviated by using crystal or piezoelectric control elements in these components.

The narrow band width requirements for the filters of the system of FIG. 3 may also be rendered less restrictive, particularly with respect to detector filter 69, by incorporating conventional sweep frequency circuits in the transmitter-receiver unit 55 or by otherwise broadening or degrading the figure of merit ("Q") for tuned-loop sensor-emitter elements 40.

Suitable and conventional combinations of component and chassis filtering and shielding should be included in transmitter section 56 and receiver section 57, to prevent system interference and instability from spuerious radiation and emanations, both externally and internally.

In the alternate form of the system of FIG. 3 earlier described in which a five megacycle crystal oscillator and mixer combination 61' is substituted for the 200 megacycle harmonic generator 61, and other modifications are made as discussed, a suitable combination mode 67' of a receiver amplifier, frequency divider, and mixer, or heterodyning circuitry, is substituted for mixer 67 in receiver section 57. A second harmonic signal reradiated by a sensor-emitter element 40 and received by antenna 65 appears at node 67 'as a five megacycle signal and, combined with the 5.001 megacycle reference signal 68, produces a 1000 cycle output signal through filter 69 to detector 70 to energize or actuate amplifier 70 and trigger its associated alarm 72. An interlocking signal path, indicated by dashed line 73, is provided to maintain tracking between the five megacycle signal at node 67' and that produced by the local oscillator 61'.

Referring now to the system block diagram of FIG. 4, another form of transmitter-receiver unit 55, operable at microwave frequencies, is illustrated schematically as generally including transmitter and receiver stations, generally delineated by chain lines 56 and 57, respectively, and a coupling component network, generally designated by the numeral 74.

The microwave system has a transmission antenna 60 and a receiving antenna 65, which may be of the general types and configurations discussed above with relation to systems such as shown in FIG. 3. In addition, spiral etched plane antennae may be used. A single antenna 75, as indicated in chain lines, may be connected to the transmitter section 56 and the receiver section 57 through an appropriate coupling element such as a tandem circulator-isolator.

A preferred form of microwave transmitter section 56 is connected to a suitable a.c. power supply leads 77 and 78 through half-Pi, or cascaded half-Pi, Pi, and Tee, line filters, designated as generalized half-Pi equivalents by the numerals 79 and 80, respectively. Line filters 79 and 80 connect to a transmitter or power oscillator 81 producing a microwave frequency fundamental transmission signal, such as 915 megacycles. Oscillator 81 is preferably rated at ten watts output at a five percent duty cycle factor. However, added transmitter range may be imparted to the system, without creating objectionable interference in the vicinity of the premises being protected, by employing circuitry producing a periodically pulsing oscillator output of 100 watts peak power, providing about ten watts average or R.M.S. power.

Power oscillator 81 is connected through a waveguide section 82 to a suitable sampler-coupler 83. Sampler-coupler 83 is connected through wavegide section 84 to one or more transmitter antenna filters, such as 915 megacycle coaxial low-pass filters 85, 86, and 87, with 1000 megacycle cut-off frequencies, series-connected through waveguide sections to transmitter antenna 60.

Sampler-coupler 83 is connected to a waveguide section 88 conducting a low power level sample of about ten milliwatts of the output power from transmitter oscillator 81 to a reference signal mixer 89. Waveguide 90 connects to sampler-coupler 89 and to a low-pass intermediate frequency filter, passing, for example, a 30 megacycle intermediate frequency signal of minus or down 20 d.b.m. to intermediate frequency reference signal waveguide or lead 91.

Reference signal mixer 89 is also connected through waveguide 92 to a power dividing node element 93, such as a four milliwatt resistive or reactive power divider. However, a directional coupler, as shown in chain lines 93', is preferred as the power dividing node 93 to minimize attentuation loss and impedance matching problems. Waveguide 94 connects the output of an 1800 megacycle cavity type local oscillator 95, producing about ten milliwatts, to power dividing node element 93.

Node element 93 divides the power output from local oscillator 95 approximately in half, sending half of the power through waveguide 92 to reference mixer 89, and half to one or more fixed tuned preselector filters 97, chosen to pass 1800 megacycles and reject 915 and 1830 megacycles.

Thus, a signal from local oscillator 95 of a power level of about four milliwatts is fed through waveguide 98 to a mixer 99, such as a balanced mixer with a rating of one-quarter to four milliwatts and a noise factor of about 7.5 decibels. Receiver antenna 65 is series-connected through one or more wave guide sections and receiver antenna preselector filters 100, which may be fixed tuned coaxial types passing 1830 megacycles and rejecting 915 megacycles, to waveguide 101 which joins to the balanced mixer 99. Hence, any 1830 megacycle second harmonic signal reradiated from a sensor-emitter element 40 and received by antenna 65 are conducted through filters 100 and waveguide 101 to balanced mixer 99 for heterodyning with the local oscillator 1800 megacycle frequency signal fed through filters 97 and waveguide 98. A difference or beat frequency the same as the 30 megacycle intermediate frequency is thus produced at waveguide or lead 102 which connects to conventional intermediate frequency circuitry, designated generally by the numeral 103, furnishing an output 104 to a suitable filter 69 having an output lead 106 for connection to a detector 70.

A combination of conventional, and preferably transistorized, intermediate frequency circuitry 103 should be chosen for an optimum balance of desirable characteristics, among which are basically a high conversion transconductance (i.e., the quotient of the intermediate frequency output current to the signal input voltage), high signal-to-noise ratio, low oscillator-signal circuit interaction and radiation, low input conductance at high frequencies, high plate or collector resistance, and other factors including economic considerations.

In an actual embodiment of the microwave system of FIG. 4, employing the parameters and frequencies discussed above, it has been determined that a suitable intermediate frequency preamplifier may have the following general characteristics: center frequency of 30 megacycles; bandwidth of 14 megacycles; power gain of 26 decibels (receiver frequency to intermediate); noise figure at 8.3 decibels; and local oscillator input signal, input, and output impedances of 50 ohms. The associated post-amplifier may have: a center frequency of 30 megacycles; a three decibel bandwidth of two megacycles; a maximum power gain of 80 to 90 decibels; a maximum voltage gain of 100 decibels; a power output of plus or up 16.5 d.b.m.; a maximum voltage output of 12 volts; an an automatic gain control range of 40 to 60 decibels, with 50 decibels being desirable.

Calculations for the system have shown that, for fundamental frequency input of less than or equal to minus or down 90 d.b.m., and a noise level of minus 160 d.b.m., the anticipated range of the second harmonic frequency for 10 watts transmitter power at 1 to 2 meters is about minus 67 to 97 d.b.m. Thus, any intermediate frequency circuitry should be designed for about minus 67 d.b.m. up to about minus 45 d.b.m.; so that its overall gain should be about plus 110 to 120 decibels to compensate for automatic gain control feedback requirements.

A more detailed illustration of one form of the system of FIG. 4 is presented in the schematic diagram of FIG. 4*a*. Power oscillator 81 may be crystal controlled or provided with pulsing circuitry or components 81' to produce, for example, periodic 100 watt peak power at 10 watts average or R.M.S., thereby approximately doubling or tripling the overall system range or sensitivity without creating objectionable interference in the locale of system installations. Similarly, conventional cascaded multiplier circuits or components may be employed with appropriate filtering; so that a more stable and inexpensive oscillator 81 of lower basic frequency may be used with the frequency multiplication techniques to produce the desired 915 megacycle transmitter power. Such an approach would alleviate the necessity for use of an overly stable 915 megacycle power oscillator 81 with maximum drift of about plus or minus one megacycle and concommittant filters of overly narrow bandwidths on the order of six to eight megacycles. Moreover, superfluous filter compromises or compensations may be averted.

In the system diagrammed in FIG. 4*a*, sampler-coupler 83 consists of a coaxial sampler 107 connected through waveguide section 88 to the reference intermediate frequency mixer 89 and of a 30 decibel coupler 108 feeding about ten milliwatts through waveguide section 109 to a mixer-doubler 110. A 15 megacycle crystal oscillator 111 is connected to a mixer-doubler 110 as at 112, or a 30 megacycle oscillator 111 may be used with an appropriately modified mixer doubler 110.

From mixer-doubler 110 a signal of about minus 10 d.b.m. is fed through path 113 to an 1800 megacycle coaxial preselector, and thence through path 115 to an 1800 megacycle coaxial amplifier 116 of about 27 decibels gain. Power leads 117 for amplifier 116 are preferably provided with line filters 118 of the type and for the purposes discussed earlier in connection with line filters 78 and 80 for power oscillator 81.

An output signal of about plus 17 d.b.m. or 50 milliwatts from amplifier 116 is carried over path 119 to local oscillator 95' which may be of a quadrature cavity type, but is preferably a hydrid ring. Local oscillator 95' is connected through an attenuation pad 120 of about six decibels to waveguide 92 connected to mixer 89. Oscillator 95' also has a tuning adjustment or pad 120 and is connected through an attentutaion pad 121 of about six decibels to 1800 megacycle preselector filters 97 of about two megacycles bandwidth.

Filters 97 are connected through path 98 to balanced mixer 99 to which leads 122 with line filters 123 connect a suitable switch 124 for instruments such as crystal meter 125.

Balanced mixer 99 is connected through waveguide 101 to an 1830 megacycle preselector receiver antenna filter 100 and thence to a ferrite isolator or circulator 126 interposed ahead of receiver antenna 65. Circulator 126 is added to eliminate possible instability effects of changes in load impedance and phase changes of reflections.

Similarly, transmitter antenna 60 is connected to a 1000 megacycle coaxial low-pass filter 127 to suppress any second harmonic effects which might originate from a ferrite isolator or circulator 128 interposed, for similar reasons as given for circulator 126, ahead of filter 127. Circulator 128 connects with a coaxial 915 megacycle preselector filter 129 with 10 to 15 megacycles bandwidth to provide increased attenuation to any second harmonic in the transmission signal.

The balance of the components and elements in the system of FIG. 4*a* are as described in detail in connection with FIG. 4.

Calculations, substantially corroborated by test results, have shown that a microwave system as just described should produce an induced second harmonic voltage in a broadly tuned sensor-emitter element 40, of the type hereinafter described, of about 110 millivolts at about 4.5 meters providing a reradiated power of about minus 90 d.b.m. down to about minus 160 d.b.m., with system range varying approximately in accordance with the sixth power of the distance of the sensor-emitter 40 from the receiver antenna 65 and the threshold range being about 300 meters.

Referring now to the block diagram of FIG. 5, another form of a microwave transmitter-receiver system 55 is illustrated. A power oscillator 81 having a relatively low frequency signal output is cascade-connected to a multiplier amplifier unit 130 and a following amplifier-multiplier unit 131. An inter-connection signal path 132 leads from multiplier amplifier 130 to the output stages of the intermediate frequency circuitry 103 and to the detector 70 to effect proper tracking and signal sampling. A suitable fundamental frequency passing filter 133, preferably 915 megacycles, is connected at one end to the output of amplifier-multiplier 131, and at the other end through coupler 134 to a transmitter antenna filter 127 at antenna 60. Leads 135 are brought out from coupler 134 for connection to a power monitor or other desired instrumentation (not shown).

Receiver antenna 65 is connected to a second harmonic bandpass filter 100, which in turn is connected to local oscillator 95 through filter 97 and mixer 99, and intermediate frequency preamplifier and postamplifier sections 103. Automatic gain control circuitry 138 is preferably provided for the postamplifier portion of sections 103, and a lead 132 is brought out for interconnection with multiplier-amplifier 130. Another lead 132 is also provided at local oscillator 95 for connection with the multiplier-amplifier 130. An appropriate 0 d.b.m. filter 137 is also included ahead of the postamplifier portion of sections 103.

The output of intermediate frequency sections 103 is connected to detector unit 70, which may be a synchronous or phase-locked type, a frequency-modulated noise or quieting type, or an amplitude-modulation detector, all as hereinafter described.

Another form of transmitter-receiver system 55 is depicted schematically in the block diagram of FIG. 6. Power or transmitter oscillator 81 is preferably crystal-controlled to an output signal frequency on path 138 of 30.5 megacycles into a mixer 139 and a six-times frequency multiplier 140, producing an output signal on path 141 of about 183 megacycles at 12 watts into a five-times frequency multiplier 142. The output on path 143 from multiplier 142 will be about 915 megacycles at 5 watts nominal power into a 915 megacycle transmitter antenna filter for antenna 60.

A signal is also fed over path 143 to mixer 139, the output of which is connected over path 145 to a suitable filter 146 passing 1799.5 megacycles over path 147 to mixer 148, which may be a diode mixer.

A filter 149 for receiver antenna 65 passes any 1830 megacycle second harmonic signals, received or reradiated from sensor-emitters 40 in the area under surveillance, over path 150 to mixer 148. The ratio of signal plus noise to noise at mixer 148 should be about 10 decibels at minus 120 d.b.m. signal level. Signals on paths 147 and 150 are heterodyned or mixed at mixer 148 to produce a difference or beat frequency on path 151 to a 30.5 megacycles intermediate frequency amplifier 152 having an output connection 153. As indicated by chain lines 154, a second stage of mixing and intermediate frequency amplification may be cascaded with amplifier 152 to impart additional sensitivity to the system 55.

Output path 153 connects to an amplitude-modulation detector 155 having an output 156 to a bandwidth limited amplifier 157 providing about a five volt output drive signal 158 to an alarm energizing, actuating, or triggering circuit 71, which may be a silicon controlled rectifier circuit, for alarm 72.

A system 55, as just described, should have an overall nominal sensitivity for second harmonic 1830 megacycles of minus 120 d.b.m. or down 120 decibels from a one milliwatt reference level. While such a system affords certain manufacturing economics by comparison with other forms of systems 55 described herein, additional shielding, filtering, adjustment, or other compensation may be required under certain installational or environmental conditions such as, for example, are present within a relatively small retail store the interior of which may constitute a many-moded wave cavity producing spurious reverberations, reflections, and emanations. Utilization of the second stage 154 of mixing and amplification should also alleviate such difficulties.

Referring now to the bifurcated schematic circuit wiring diagram of FIG.'s 7 and 7*a*, one preferred and actual embodiment of a synchronous or phase-locked detection circuit 70 for a transmitter-receiver system 55 will now be described in detail with particular reference to exemplary application in the systems 55 of FIG.'s 4 and 4*a*, the circuit 70 having a reference signal input 91 (FIG. 7) and an intermediate frequency signal input 106 (FIG. 7*a*).

Reference signal input 91 (typically 30 megacycles), at about 50 ohms and minus 30 to minus 15 d.b.m., connects to a first half-Pi attenuation pad 159, each leg of which consists of a 16.7 ohm registor. The base or shunt leg of pad 159 connects to a section of 50 ohm coaxial cable 160 about 2.5 meters in length leading to a second detector circuit, designated generally by block 161, which is identical in makeup to that shown in FIG.'s 7 and 7*a* and now being described in detail. Coaxial cable 160 effects a phase shift attenuation of about 90 degrees or one-quarter of a sinusoidal wave cycle; so that a sine wave input at 91 is conducted over cable 190 and appears at the input to circuit 161 as a cosine wave.

Pad 159 is series-connected to a second half-Pi attenuation pad 162 and a third such pad 163, each pad consisting of 16.7 ohm resistors with the shunt leg of each being grounded. Pad 163 connects to the primary section 164 of a tuning circuit, designated generally by the numeral 165. Section 164 is composed of a 100 ohm resistor 166, a 10 picofarad (micro-micro-farad) capacitor 167, and a 14 turn variable tap reactor or coupling transformer winding 168 with grounded centertap, all parallel-connected. A secondary section 169 includes a 50 ohm resistor 170 with one side connected to winding 168 at a tap three turns from its first end, and the other side connected to a lead 171. The balance of section 169 consists of a variable capacitor 172 of 10–110 picofarads with one side connected to lead 171, and the other to winding 168 at a tap two turns from its second end.

Lead 171 connects to a tertiary section or stage 173 of tuning circuit 165, which is a parallel combination to ground of a 10 picofarad capacitor 174 and a 20 turn variable-tap winding 175. The base connection 176 for a first amplifier stage of an NPN transistor T1 is connected to winding 175 at a point seven turns from one end. The emitter 177 for transistor T1 is biased by a 2200 picofarad capacitor 178 connected to ground and by a 1.2 kilohm resistor 179 connected to a 30 microhenry radio frequency choke 180 leading to the biasing for a second amplifier stage.

Collector 181 for transistor T1 is connected to a nine turn winding 182, at a tap 3.8 turns from one end, in a stage coupling circuit 183 consisting of a parallel combination of winding 182, a 27 picofarad capacitor 184, and a 2–20 picofarad variable capacitor 185. A tap lead 186 connects to winding 182, at a point 3.8 turns from one end, and, through a 0.05 microfarad capacitor 187, to base connection 188 for a second amplifier stage of an NPN transistor T2. Base connection 188 is also connected through a 1.2 kilohm resistor 189 to ground. A lead 190 connects coupling circuit 183 to a 30 microhenry radio frequency choke 191 leading to the next stage of amplification. A 2200 picofarad capacitor 192 also connects lead 190 to ground.

Emitter 193 connects through a 1.2 kilohm resistor 194 to choke 180 and to one end of another 30 microhenry radio frequency choke 195 leading to a third amplification stage. Emitter 193 is also connected to ground through a 2200 picofarad capacitor 196.

Collector 197 for transistor T2 is connected to a nine turn winding 198, at a tap 3.8 turns fron one end, in a stage coupling circuit 199 composed of a parallel combination of winding 198, a 27 picofarad capacitor 200, and a 2–20 picofarad variable capacitor 201. A tap lead 202 connects to winding 198, at a point 3.8 turns from one end, and, through a 0.05 microfarad capacitor 203, to base connection 204 for a third or output amplifier stage of an N P N transistor T3. Base connection 204 is also connected through a 120 ohm resistor 205 to ground. A lead 206 connects coupling circuit 199 to a 30 microhenry radio frequency choke 207 leading to the next amplifier stage. A 2200 picofarad capacitor 208 also connects lead 206 to ground.

Emitter 209 for transistor T3 connects through a 82 ohm resistor 210 to choke 195 and to one end of another 30 microhenry radio frequency choke 211. A lead 212 connects to the other side of choke 211. Emitter 209 is also connected to ground through a 2200 picofarad capacitor 213.

Collector 214 for transistor T3 connects to a three turn primary winding 215 for a transformer 216, the other side of which is connected to a lead 217. Lead 217 is connected to one side of choke 207 and one side of another 30 microhenry radio frequency choke 218, the other side of which is connected to a lead 219. Lead 217 is also connected to a 2200 picofarad capacitor 220, the other side of which is grounded.

A 14 turn secondary winding 221 for transformer 216 has end taps 222 and 223 across which is connected a parallel combination of a 10 picofarad capacitor 224 and a 1–7 picofarad capacitor 225. Tap 222 terminates at one end of a 1.8 kilohm (1% tolerance) resistor 226; while tap 223 terminates in a resistor 227 of identical value and tolerance. The other end of resistor 226 is joined to a resistor 228; and the other end of resistor 227, to a resistor 229, all the resistors being of identical values and tolerances.

A centertap 230 of secondary winding 221 is connected through a 0.05 microfarad capacitor 231 to a junction 232 of resistors 228 and 229. Junction 232 is connected through a 0.05 microfarad capacitor 233 to ground, and also through a 1.8 kilohm resistor 234 to ground. A lead 232' may also be brought out from junction 232 for connection to a d.c. monitor or other instrumentation. Junction 232 also connects to one side of a 10 kilohm resistor 235, the other side of which connects to a lead 236 which is connected through a six picofarad capacitor 237 to ground.

The junction of resistors 226 and 228 is connected to a diode D1; and the junction of resistors 227 and 229, to a diode D2, the other sides of diodes D1 and D2 being joined to a lead 238.

A lead 239, corresponding to lead 236, is brought out from the identical synchronous detector circuitry designated generally by the numeral 161, as well as another lead 240.

Referring now to the continuation of detector circuit 70 on FIG. 7*a*, lead 219 connects through a 30 microhenry radio frequency choke 241 to a positive 12 volt d.c. supply lead 242; and lead 212, through an identical choke 243 to a negative 12 volt d.c. supply lead 244.

Lead 238 is connected to ground through a parallel combination of a varible 1–7 picofarad capacitor 245, a 10 picofarad capacitor 246, and a nine turn secondary winding 247 of a coupling transformer 248 having an eight turn primary 249.

Thus, diodes D1 and D2, together with the above-described elements numbered 221 through 238 and 245 through 247, both inclusive, combine to form a signal mixing, rectifying, and integrating subsidiary circuit, designated generally by the numeral 250. Circuit 250 ultimately combines a reference input signal on lead 91 and a received intermediate frequency circuit signal on lead 106 to form an output for detector circuit 70 on lead 236 (or 239 for the duplicate detector circuitry 161) in a manner and of a type which will be understood from the remaining detailed description of circuit 70.

Winding 249 is connected at one end to lead 219 which is connected through a 2200 picofarad capacitor 251 to ground. The other end of winding 249 joins to the collector 252 of an N P N transistor T4, the emitter 253 of which is biased by a 2200 picofarad capacitor 254 to ground and a 1.2 kilohm resistor 255 to lead 212.

Base 256 for transistor T4 is connected to a nine turn coil 257 at a point 1.9 turns from its grounded end, coil 257 having a 27 picofarad capacitor 258 and a 2–20 picofarad variable capacitor 259 connected in parallel.

A variable tap 260, positioned eight turns from the grounded end of coil 257, is gounded through a 68 ohm resistor 261 and joins to three series connected half-Pi attenuation pads, designated by the numerals 262, 263, and 264 leading to a 50 ohm signal input lead 106 from the intermediate frequency circuit 103. (See, for example, the schematic diagrams of FIG'S. 4, 4*a* and 5.)

Attenuation pads 262 and 263 are composed of legs of 16.7 ohm resistors, with the shunt leg being grounded. Pad 264 is also composed of 16.7 ohm resistor legs, but the shunt leg joins to lead 240 for the second detector circuit 161.

In circuit 70, as just described, transistors T1, T2, and T4 may be of the 2N3855 type; T3, of the 2N3300 type; and diodes D1 and D2, of the 1N3064 type. Or components having the equivalent or similar characteristics may, of course, be employed. In any event, diodes D1 and D2, and associated parameter elements, should be carefully selected for proper balancing and compensation for stray capacitance to ensure a high level of sensitivity of subsidiary circuit 250 without incurring hypersensitivity.

The synchronous detection circuit 70, as above-described, combines reference signal inputs at leads 91 and 160 with received signals at leads 106 and 240 to produce appropriate output signals at leads 236 and 239 to alarm actuation circuitry 71. The output signal on lead 236 will have an amplitude proportional to the product of the amplitude of signals on leads 91 and 106 and the sine function of the reference signal frequency. The output signal on lead 239 will have an amplitude proportional to the product of signal amplitudes on leads 160 and 240 and the cosine function of the reference signal frequency.

Referring now to FIG. 7*b*, a schematic wiring diagram illustrates one form of alarm actuation, energization, or triggering circuitry, designated generally by the numeral 71. Lead 236 connects to the anode of a diode D3 and to the cathode of a diode D4; and lead 239, to the anode of a diode D5 and the cathode of a diode D6. The cathodes of diodes D3 and D5 are joined to the base 265 of an N P N transistor 266, of type 2N2480, the emitter 267 of which leads through a 10 kilohm resistor 268 to a negative 12 volt d.c. supply. Emitter 269 for an N P N transistor 270, of type 2N2480, is also connected to resistor 268.

Collector 271 for transistor 266 is connected through a 4.7 kilohm resistor 272 to a positive 12 volt d.c. supply 273 which is also connected, through a 4.7 kilohm resistor 274, to the collector 275 for transistor 270. Base 276, for transistor 270, joins to the cathode of a diode D7, the anode of which is connected to a 56 kilohm resistor 277, the other end of which is connected, through a 22 kilohm resistor 278, to supply lead 273 and, through a 100 ohm variable resistor 279, to ground.

Collector 271 for transistor 266 is also tied to the base 280 of P N P transistor 281, of type 2N3638, the emitter 282 of which is tied to collector 275 of transistor 270. Collector 283 for transistor 281 joins to a tie lead 284.

The anodes of diodes D4 and D6 are joined to the base 285 of an N P N transistor 286, of type 2N2480, the emitter 287 of which leads through a 10 kilohm resistor 288 to a negative 12 volt d.c. supply. Emitter 289 for an N P N transistor 290, of type 2N2480, is also connected to resistor 288.

Collector 291 for transistor is connected through a 4.7 kilohm resistor 292 to a positive 12 volt d.c. supply 193 which is also connected, through a 4.7 kilohm resistor 294, to the collector 295 for transistor 290. Base 296 for transistor 290 joins to the cathode of a diode D8, the anode of which is connected to a 56 kilohm resistor 297, the other end of which is connected, through a 22 kilohm resistor 298, to supply lead 293 and, through a 100 ohm variable resistor 299, to ground.

Collector 291 for transistor 286 is also tied to the base 300 of a P N P transistor 301, of type 2N3638, the emitter 302 of which is tied to collector 295 of transistor 290. Collector 303 for transistor 301 joins to tie lead 284.

Diodes D3, D5, and D7 are preferably chosen from a matched quad of type FA4000; while diodes D4, D6 and D8 are of the same type, also chosen from a matched quad.

Tie lead 284 connects to a grounded 20 kilohm resistor 304 and a grounded 10 microfarad capacitor 305, as well as the base 306 of an N P N type 2N3567 transistor 307. Collector 308 for transistor 307 connects to a positive 12 volt d.c. supply, and emitter 309 connects through a one kilohm resistor 310 to a gate lead 311 for a silicon controlled rectifier 312, of type C11B, the cathode of which is grounded. Gate lead 311 is connected to ground through a one kilohm resistor 313 and through a 0.1 microfarad capacitor 314.

The anode 315 of S.C.R. 312 is connected to one end of a two ohm resistor 316, the other end of which is connected to one end of a two ohm resistor 317 and to ground through a ten microfarad capacitor 318.

The other end of resistor 317 connects, through a reset button 319, to one side of an alarm lamp 72, the other side of which is connected to a positive 12 volt d.c. supply lead.

The d.c. integrating and switching network 71 just described may be replaced by a consolidated circuit, a mirror-image one-half of which is shown in FIG. 7*c*, utilizing an integrated circuit component 320, such as a type pA710C dual differential comparator, (e.g., Fairchild pA77103-607.)

Signal lead 236 from detector circuit 70 is connected to the input side of comparator 320; and a positive 12 volt d.c. supply is also connected, through a 2.9 megohm resistor 321, to comparator 320 by lead 322. Voltage at lead 322 is maintained at 50 millivolts positive by a 12 kilohm resistor 323 to ground.

A negative 12 volt d.c. supply is connected, through a 2.9 megohm resistor 324, by lead 325 to comparator 320. Voltage at lead 325 is maintained at 50 millivolts negative by a 12 kilohm resistor 326 to ground.

Output 327 of comparator 320 is connected, through a 200 ohm resistor 328, to gating lead 311 of an S.C.R. triggering element 312. The anode of S.C.R. 312 is connected, through a one ohm (one watt) resistor 329, to reset button 319 and to ground through a one microfarad capacitor 330; while the cathode is grounded.

The preferred detector circuit 70 and alarm actuation circuit 71 for the system 55 consist generally of two channels with input signals 90° or a quarter of a cycle out of phase. However, it has been found that unauthorized removal from the protected premises of an article 42, with an active sensor-emitter 40 thereon, will be detected by a single-channel circuit 70 if the article is moved through the surveillance field (51, 52) out of phase by one-eighth of a wave length (which at the exemplary operating frequencies is about 30 centimeters). Hence, in many applications only single-channel circuits 70 may be required.

Referring now to the schematic circuit wiring diagram of FIG. 8, a modified form of detection circuit 70, which is particularly adapted to the form of system 55 illustrated in FIG. 5, is designated generally by the numeral 70*a*. Detector circuit 70*a* generally operates upon the principles of frequency modulation noise quieting and employs drift compensation.

A ground lead is brought in from receiver circuitry 103, as well as the intermediate frequency signal input lead 106 which connects to one side of a 25 kilohm trigger level potentiometer winding 331, the other side of which is connected to ground. Potentiometer tap 332 for winding 331 is connected, through a 0.1 microfarad capacitor 333, to the cathode and anode, respectively, of diodes 334 and 335. The anode of diode 334 is connected to a common lead 336 which is maintained at 10 volts negative, and the cathode of diode 335 connects to a lead 337.

Common lead 336 connects, through a five microfarad capacitor 338, to a lead 339 which joins to the number 1 junction of a unijunction transistor 340 of type 2N491. Lead 339 also connects, through a 27 kilohm resistor 341, to a 500 kilohm potentiometer winding 342 for time duration adjustment. Lead 336 is also connected, through a 100 ohm resistor 343, to the number 2 junction of transistor 340; and the number 4 junction is connected to one side of a 0.04 microfarad capacitor 344, and, through a one kilohm resistor, to a common lead 346 which is maintained at 10 volts positive.

The other side of capacitor 344 is connected to the cathode of a diode 347 and, through a 33 kilohm resistor 348, to ground. The anode of diode 347 is connected to a lead 349 and, through a 33 kilohm resistor 350, to common lead 336. Lead 349 joins to the base of an N P N transistor 352, of type 2N3391, the emitter 353 of which is grounded. Collector 354 of transistor 352 connects, through a one kilohm resistor 355, to common lead 346, and, through a 27 kilohm resistor 356, to the base 357 of an N P N transistor 358 of type 2N3391. Base 357 is also connected to the anode of a diode 359 and, through a 33 kilohm resistor 360, to common lead 336. The emitter 361 of transistor 358 is grounded, and the collector 362 joins to a node 363.

Node 363 is joined: through a 27 kilohm resistor 364, to base 351 of transistor 352; through a one kilohm resistor 365, to common lead 346; through a 47 kilohm resistor 366, to a lead 367; and to the tap 368 for potentiometer winding 342.

Lead 367 is connected, through an 82 kilohm resistor 369, to ground and also to the base input of tandem Darlington-connected N P N transistors 370 and 371, of types 2N3391 and 2N3405, respectively. The emitter of transistor 370 and the base of transistor 371 are joined to a 1.8 kilohm resistor 372 to ground, and the emitter of transistor 371 is grounded. The collectors of transistors 370 and 371 join to form an output lead 373 to one side of a d.c. relay coil 374, the other side of which is connected, through a lamp 375, to a lead 376. Lead 376 is connected, through a lamp 377, to positive 10 volt common lead 346, which connects to the cathode of a 10 volt (one watt) Zener diode 378, of type 1N1523, the anode of which is grounded. Lead 376 also connects to the cathode of a diode 379 and, through a 500 microfarad (25 volt) capacitor 380, to ground.

The anode of diode 379 joins to one lead of a 12 volt a.c. supply and to the cathode of a diode 380, the anode of which joins a lead 381.

Lead 381 is grounded through a 500 microfarad (25 volt) capacitor 382, and joins to one side of a 350 ohm (two watt) resistor 383, the other side of which joins to negative 10 volt common lead 336 and to the anode of a 10 volt (one watt) Zener diode 384 of type 1N1523. The cathode of diode 384 is grounded.

Lead 336 also connects, through an 82 kilohm resistor 385, to the cathode of diode 359 and to one side of a 10 kilohm resistor 386, the other side of which is connected to lead 337. Lead 337 is grounded through a 0.1 microfarad capacitor 387.

Lead 381 also joins to the fixed pole 388 of a normally open contact 389 which, as indicated by the dashed line, is closed upon energization of d.c. relay 374. Additional relay contacts may also be provided for relay coil 374, if desired, for actuation of other alarm devices or functions.

Contact 389 provides an emitter input for a transistorized oscillator, designated and delimited generally by dashed lines 390, which may have a 100 kilohm resistor 391 and a 0.5 microfarad capacitor 392.

The collector output 393 of oscillator 390 is connected to one side of a suitable monitoring device such as a speaker (not shown); while the emitter output 394 is connected to one side of the 12 volt a.c. supply and to the other side of the speaker.

Referring now to the block diagram of FIG. 9, an alternate arrangement of input components, designated generally by the numeral 395, for a synchronous detector 70 is depicted schematically.

A received input signal 106 of 30 megacycles, plus or minus one megacycle, is fed into a receiver mixer 396 into which a signal 397 of 28 megacycles, plus or minus one megacycle, is also fed from a local oscillator 398. A like 28 megacycle signal 399 is also fed from oscillator 398 into a reference mixer 400, into which a reference signal 91 of 30, plus or minus one, megacycles is fed.

A two megacycles output signal 401 passes through a narrow band two megacycle filter 402, which may have a 20 kilocycle bandwidth, to synchronous detector 70 with output 236 (or 239) to the alarm circuitry 71.

Reference mixer 400 produces a two megacycles output signal 403 which is fed to the synchronous detector 70 and to a frequency discriminator 404. Discriminator 404 has appropriate automatic frequency control circuitry adapted to produce a d.c. control voltage reference 405 to control accurately the output frequency of local oscillator 398.

With arrangement 395, as just described, it is possible to control the two megacycle center frequency to within plus or minus 0.1%; and only about 40 decibels of noise reduction is required, instead of about 60 decibels at 30 megacycles. Moreover, narrow band filtering may be employed.

One form of tuned-loop sensor-emitter element 40, particularly adapted for use with the transmitter-receiver system 55 of FIG. 3, is illustrated in FIG'S. 10 and 11. Referring to the sectional view of FIG. 10, a non-conducting backing material layer 406 has deposited thereon, or laminated or adhered thereto, a thin film or layer of ferrite 407, having high retentivity and being permanently magnetizable. A second layer or film of ferrite 408, of soft low retentivity material and preferably about one-half the thickness of layer or film 407, is positioned, laminated or deposited atop layer 407. An inner antenna loop 409 and an outer antenna loop 410, preferably of copper, are positioned on ferrite layer 408 and covered by a layer of nonconducting material 411 which may serve as a surface for price or label information.

Referring to FIG. 11, loop 409 is formed with an air gap 412 across which a capacitance 413 is connected; and loop 410 has an air gap 414 with a shunting capacitance 415. Loops 409 and 410 are joined by a nonlinear capacitor 416, such as a reverse-biased diode using autobiasing.

Loops 409 and 410 may be die-stamped from copper foil; and ferrite layers 407 and 408, from ferrite film. In this case, the backing, film, foil, discrete capacitances, and cover materials are laminated or assembled. Or, the various parts may be deposited by vacuum electrolysis or evaporation techniques.

Loop 410 and 409 are tuned or resonated by capacitances 413, 415, and 416, utilizing the parametric principle to produce harmonic reradiation, to the fundamental transmission frequency for the system 55 and its second harmonic frequency, respectively. (e.g., 100 and 200 megacycles.)

Initially, tuned-loop sensor-emitter 40 is activated, before application to articles or mechandise under surveillance, by placing it in a magnetic field of sufficient strength to saturate ferrite layer 407 which then remains saturated. Since magnetic flux through layer 407 returns through layer 408, which is thinner than layer 407, layer 408 is also held saturated. The inductances of the antenna loops are thus generally unaffected by the presence of the ferrite.

Tuned-loop sensor-emitter 40 may then be deactivated by subjecting it to an a.c. magnetic field to demagnetize ferrite layer 407.

Ferrite layer 408 then possesses high permeability and the inductances of the loops are approximately double their former value. This change reduces the reaction fields by a factor of about a combined loop merit figure (Q) of 100; and an appropriate adjustment may be made in the threshold sensitivity of the receiver system 57.

With the above-described configuration, at 100 megacycles fundamental frequency for the system 55, the voltage across gap 414 may be up to three volts and is of sufficient magnitude for significant nonlinearity to be obtained. With a five percent conversion efficiency, a second harmonic electrical reaction field of approximately 7.8 millivolts per meter is produced and can be readily detected.

Referring now to FIG'S. 12 and 13, another form of tuned-loop sensor-emitter 40 is illustrated. As shown by the diametrical section view of FIG. 12, the layer construction is similar to that of element 40 of FIG. 10, except that only one layer of ferrite film 417 is present. In this case, the ferrite film 417 has a square loop hysteresis characteristic and low loss factors at the fundamental frequency.

Suitable ferrite films or layers 407, 408, and 417 may be chosen from various grades produced by electrical decomposition of varying proportions of iron, manganese, and nickel oxides, as well as other materials such as cobalt.

As seen by comparison with the plan view of FIG. 11, the tuned-loop sensor-emitter 40 shown in the plan sectional view of FIG. 13 eliminates capacitances 413 and 415.

For the tuned-loop sensor-emitters 40 of both FIG'S. 11 and 13, the outer radius 418 of the inner loop 409 should be about two-thirds of the inner radius 419 of outer loop 410, with the radial widths of the loops being about the same. The circumferential widths of gaps 412 and 414 should be about half the radial widths of their respective loops 409 and 410. The axial thickness of the tuned-loop sensor-emitter elements 40 may be as small as five-thousandths of an inch or less.

Overall system sensitivity will be proportional to the product of the quality factors or figures of merit (Q) for loops 409 and 410. As demonstrated by the schematic equivalent circuit of FIG. 14, these factors are determined by several transient and steady-state properties or parameters of the loops and associated components and materials. Skin effect conduction, resistive and radiation losses, and coupling losses in the second harmonic circuit 409 are among the more important considerations in optimizing construction and configuration of elements 40 to attain a suitable combined figure of merit and sensitivity. For example, a figure of merit of about 100 is desired for a 100 megacycle fundamental frequency.

Referring now to FIG.'S. 15 and 16, a form of tuned-loop sensor-emitter 40, as illustrated, using only one antenna loop 410 tuned to resonate and reradiate at the fundamental system frequency, may be employed in applications in which selectivity does not pose a problem because no articles 42 are present which are sufficiently conductive to distort the applied fundamental frequency field through creation of eddy currents.

Where such conductive objects are present, however, use of nonlinear sensor-emitters 40 reradiating at second or subsequent harmonic frequencies will provide proper selectivity; since ordinary conductive objects are linear and cannot produce harmonic field radiation.

As depicted generally by FIG. 19, exit pathways 49 may be bordered by d.c. magnetic coils 420 and 421, establishing a d.c. magnetic field to saturate ferrite layers 407, 408, and 417 of sensor-emitters 40 which had previously been in a deactivated or passive state. Thus, procedures of preliminary activation and deactivation, for authorized removal, as hereinafter described, need not be performed.

Referring now to FIG. 17, one form of sensor-emitter 40, generally of a type of relatively untuned or broadly tuned loop 425 is shown, somewhat schematically, within a label or encapsulation, designated generally by dashed lines 426. Loop 425 is formed of a nonlinear ceramic capacitor or diode 427 with its axial leads joined and formed into a folded dipole antenna configuration of about one-half of a wavelength. For example, the oval loop thus formed may have a major axis of about thirty times the length of the minor axis, the diameter of the axial leads 428 being about one-fourth of the minor axis dimension. Among suitable diodes for elements 427 are included low capacitance planar diodes, diffused mesa silicon diodes, and other similar types composed of germanium, silicon or other suitable semiconductor materials, which may be chosen from Groups III, IV, and V of the Periodic Table of the Atomic Elements. The diodes are preferably formed by chipping or dicing the semiconductor material, and oxidizing or depositing an insulating coating on its surface, rather than encapsulating or otherwise separately treating it to provide insulation. The semiconductor material used is preferably silicon with a deposited covering of silicon nitrite; although oxides of silicon or germanium may be formed on chips of the respective materials.

The axial leads 428 are preferably extremely thin gold; although aluminum and other efficient conducting and radiating materials may be utilized. Similarly, while the axial leads 428 are preferably approximately half a wavelength for most efficient reradiation, quarter wavelength leads may be used.

The relatively untuned or broadly tuned loops 425 are particularly well adapted for use with systems 55 operating at microwave frequencies. (See, for example, FIGS. 4, 4*a*, 5, and 6.) At the preferred operating fundamental and second harmonic operating frequencies of 915 and 1830 megacycles, respectively, the diodes 427, as actually used in one preferred embodiment of the system, may have the following general characteristics: zero bias capacitance (at minus one volt) of 0.5 to 1.1 microfarads, with 0.8 plus or minus 0.2 or 0.3 microfarads being preferred; relative forward voltage (at one milliampere) of about 0.260 to 0.290 volts; cut-off frequency of greater than or equal to 4000 megacycles; reverse breakdown voltage of greater than or equal to one volt.

As seen in FIG. 18, loop 425 may be formed with axial leads 428 of diode 427 in a circular loop configuration. Or, as shown in FIG. 20, tuning with an inner loop 429, having an air gap or capacitance 430, may be employed. Moreover, if other than a zero bias capacitance diode 427 is used, one or more biasing capacitances 431 may be included.

FIG. 21 shows a construction for diode 427, without encapsulation, in which a soft iron lead or whisker 432, a few microns in diameter, makes contact with a tungsten surface 433 in a germanium or silicon chip 434. The diode may be deactivated by placing it in a d. c. magnetic field with transverse flux, whereupon a moment is exerted upon whisker 432 to shift it to the chain line position, thereby breaking contact. Another similar construction of diode 427 for transverse d. c. field deactivation is shown in the enlarged sectional view of FIG. 22 wherein a dipole repulsion force is produced for separation between the whisker 432 and positively polarized lead end 428, with semiconductor chip 434 thereon.

FIG. 23 illustrates schematically another configuration for broadly tuned sensor-emitter 425 in which the axial leads 428 for diode 427 are wound into an Archimedes or logarithmic spiral so as to produce a circularly polarized reradiation field vector. Leads 428 may be joined by a fusible element 435 melts open for deactivation upon production of excessive current flow in the loop.

All forms of tuned sensor-emitters 40 and relatively untuned or broadly tuned loops 425 should be constructed to produce optimum electromagnetic reradiation effects, which phenomena, according to Maxwell's principle, will depend upon the parameters determining conduction and displacement currents.

The isometric view of FIG. 24 illustrates a ferrite or ferrox core 436 with a layer-coil winding 437 and poles 438 producing a d. c. magnetic field 439 for a deactivation unit for a relatively untuned or broadly tuned loop 425, designated generally by the numeral 440. As shown in FIG. 31, poles 438 may be shaped, if desired, for increased concentration or depth of field 439.

The schematic wiring diagram of FIG. 25 represents one form of circuitry for actuation of a deactivation unit 440. A 110 volt a. c. transformer primary 441 produces 2700 volts R.M.S. at a secondary 442 and sufficient voltage at a pair of tertiary gating windings 443 to trigger back-to-back 4000 volt thyratons, silicon switches, silicon controlled rectifiers, or other power switches 444, such as S.C.R.'s of type MC 1708, which are isolated from the secondary 442 by a 10 henry inductor 445, and from two microhenry core coil 437 by a 0.5 microfarad capacitor 446. The circuit will resonate at 100 kilocycles.

The fragmentary perspective view of FIG. 26 depicts an arrangement of deactivation units at a conveyor check-out counter 46 in which a reflecting tunnel 447, of aluminum, mu-metal, or other suitable shielding material, in conjunction with a plurality of spatially arrayed deactivation units 440, establishes a relatively uniform density deactivation field throughout a sizeable merchandise passageway volume. Similarly, FIG. 27 illustrates the use of a shield plate 447 to produce reverberation concentration of deactivation flux 439. In this arrangement, deactivation unit 440 is connected to a tuning and matching unit 448 joined to the output 449 of a pulsing magnetron (not shown) of, for example, one kilowatt peak pulse power and one to two watts average power.

The schematic wiring diagram of FIG. 28 shows a solid-state switching circuit, designated generally by the numeral 450, for actuation of the coil 437 for a deactivation unit 440. A 110 volt R.M.S. transformer primary winding 451 produces a 390 volt R.M.S. 550 volt peak, potential between secondary tap leads 452 and 453, and 110 volts R.M.S. between tap leads 453 and 454. Tap leads 452 and 453 are shunted by a suitable voltage damping capacitor 455 and resistor 456 for transient suppression.

Lead 452 conducts about 0.7 amperes through a 100 ohm resistor 457 and two three ampere (100 volts peak inverse) cascaded diodes 458, such as type 1N4725 or MR1040, for peak reflective forward current of 25 amperes and non-reflective surge of 300 amperes, and a capacitance of 50 microfarads at 1000 volts, to node 459. One end of core coil 437 is connected to node 459, the other, through a two microfarad, 1000 volt capacitor 460, to tap lead 453.

The cathode of two series-connected diodes 461 joins to node 459, the anode to lead 453. The anodes of a series of two diodes 462 also connect to node 459. Diodes 461 and 462 should be selected from a matched quad of 160 ampere units (non-reflective peak surge current of 3600 amperes), such as type MR1227 SB.

The cathode of diodes 462 connects to a node 463, from which two, or preferably four, S.C.R.'s 464 are connected forward to lead 453. A timing circuit of a series-connected 12 kilohm (5 watt) resistor 465 and a 0.33 microfarad (1000 volt) capacitor 466 is also connected from node 463 to lead 453 to produce a time constant of about four milliseconds.

Gate connections 467 for cascaded S.C.R.'s 464 are connected to lead 453 through 560 ohm resistors 468, and, through 0.2 microfarad capacitors 469, to a first output connection 470 for a unijunction transistor 471 of type 2N3484.

A second output connection 473 for transistor 471 is connected, through a 100 ohm resistor 474, to a node 475. Node 475 is connected to one side of a 4.7 kilohm resistor 476, the other side of which is joined to emitter 477 for transistor 471. Emitter 477 is connected through a one microfarad capacitor 478 to lead 453.

A 33 volt (one watt) Zener diode 479, of type 1N3032, is connected forward from lead 453 to node 475, which connects, through a 4.7 kilohm (five watt) resistor 480, to tap lead 454.

An alternate deactivation unit circuit, designated generally by the numeral 450-*a*, is shown in FIG. 29, in which about a 10 kilovolt peak potential is applied, from secondary 442, through a suitable resistor 481 and cascaded diodes 482 to a current discharge circuit formed by core coil 437 and a suitable capacitor 483. Current switching is accomplished by a shunting vacuum relay contact 484 actuated by relay coil 485, which is energized by tertiary 443 through a diode 486.

Another form of circuit for a deactivation unit 440 is shown in the schematic wiring diagram of FIG. 30. Suitably shielded and fused 110 volt, two ampere a. c. power lines 487 and 488 may be selectively connected, through line switch 489, to a 6.3 volt, 3 ampere cathode heater transformer 490 for a beam power tube 490, such as a type 6DQ5.

Line 487 connects to a diode d. c. voltage supply 491 from which a positive 150 volt lead 492, a positive 400 volt lead 493, and a ground lead 494 emerge.

Lead 492 connects, through an 1100 ohm (five watt) resistor 495, to the screen grid 496 of pentode 490, screen grid 496 being connected to the cathode 497 through a 0.01 microfarad capacitor 498. Cathode 497 is also selectively connected to ground 494 through a unit actuation switch 499, and is tied to the plate grid 500.

The control grid 501 is connected to one side of the primary 502 of a loop stick or search coil 503 energizing a lamp 504. Primary 502 is shunted by a variable 30 to 300 microfarad mica capacitor 505, and is connected, through a parallel combination of an 18 kilohm (three watt) resistor 506 and a 0.002 microfarad capacitor 507, to cathode 497.

Cathode 497 is also joined, through a 0.1 microfarad capacitor 508, to one end of a winding 437 for a four turn pancake core 438. Core 438 is positioned beneath the work area 46 and is shielded by a Faraday shield 509.

The other end of winding 437 is joined, through a 30 micro-henry coil 510, to the plate 511 for tube 490, and to 400 volt lead 493 through a 0.005 (2000 volt, 7.5 ampere) mica capacitor 512.

As will be understood from the foregoing, the various methods of deactivation of sensor-emitters 40 involve desaturation, in the case of tuned-loop elements; and diode or capacitance surge destruction or open circuiting of fusible elements or magnetizable whiskers, in the instance of relatively untuned or broadly tuned loops 425.

It may also be desirable to provide visual indication of deactivation, and this may be accomplished by selecting encapsulating materials for the sensor-emitters 40 of heat-sensitive composition producing a discoloration or change in color upon deactivation. Or, acid or alkaline salts or film deposits may be incorporated in elements 40 producing an electrolytic change in pH and color upon voltage variations during deactivation.

Referring now to the block diagram of FIG. 32, another form of transmitter-receiver system 55, employing modulation and demodulation techniques, is illustrated schematically.

A one kilocycle pulse generator 513 power oscillator 514 to produce a 915 megacycle signal through filtering 515 to transmitter antenna 60. As shown by frequency spectrum graph 516, sidebands are created about the 915 megacycle carrier 517 at a bandwidth of 1000 cycles per second.

A reference mixer 519 produces a reference signal 91 which, as shown on spectrum graph 520, peaks at 30 megacycles. An 1800 megacycle local oscillator 521 feeds a receiver mixer 522 to produce a beat frequency signal 102 having a spectrum pattern about the 30 megacycle center frequency as shown in graph 523.

It will also be appreciated that sweep frequency transmission and reception techniques may be employed with selection of an appropriate detection datum for the synchronous or other detector 70.

It should therefore be apparent, to those skilled in the art, that the above-disclosed preferred embodiments and techniques of the present invention accomplish the several objects of the invention.

We claim:

1. An article surveillance system comprising transmitting means to establish an electromagnetic wave field within a surveillance zone, passive sensor-emitter means for application to an article susceptible of relative movement into said surveillance zone, said sensor-emitter means comprising a two-terminal nonlinear impedance element conductively connected directly to antenna means supported by a structure adapted to be secured to said article under surveillance, said nonlinear impedance element cooperating with said antenna means when in said zone to reradiate at least a portion of the energy in said wave field in the form of a signal which is different and distinguishable from any signal otherwise present in said wave field, and receiving means to detect said reradiated signal to the exclusion of any signals produced directly by said transmitting means.

2. An article surveillance system according to claim 1, wherein said transmitting means produces an electromagnetic wave field of a given frequency of at least 100 megacycles per second, and said reradiated signal has a frequency equal to the second or higher harmonic of said given frequency.

3. An article surveillance system according to claim 2, wherein the sensor-emitter means further comprises a capacitive resonator element, and the antenna means comprises at least one conductive reradiating antenna member having an end thereof joined to said capacitive resonator element.

4. An article surveillance system according to claim 2, wherein said impedance element is a semiconductor diode adapted to operate as a nonlinear capacitor.

5. An article surveillance system according to claim 1, which includes deactivation means for desensitizing said sensor-emitter means on an article authorized for undetected presence in the surveillance zone.

6. An article surveillance system according to claim 1, which includes an alarm actuation means coupled to said receiving means responsive to the detected reradiated signal for providing an alarm.

7. An article surveillance system according to claim 1, wherein said impedance element is a semiconductor diode adapted to operate as a nonlinear capacitor.

8. An article surveillance system comprising transmitting means to establish an electromagnetic wave field of a given frequency within a surveillance zone, passive sensor-emitter means for application to an article susceptible of relative movement into said surveillance zone, said sensor-emitter means comprising conductive antenna means directly connected to a nonlinear impedance element and carried by a supporting structure adapted to be secured to said article under surveillance, said nonlinear impedance element cooperating with said antenna means when in said zone to reradiate at least a portion of the energy in said wave field in the form of a signal having a frequency which is equal to the second or higher harmonic of said given frequency, and high gain receiving means tuned to detect said reradiated signal at its harmonic frequency while discriminating against any signals of said given frequency, whereby high sensitivity for detection of said sensor-emitter means is obtained without interference from said transmitting means.

9. An article surveillance system comprising transmitting means to establish an electromagnetic wave field within a surveillance zone, passive sensor-emitter means for application to articles susceptible of movement into said surveillance zone, each of said sensor-emitter means comprising a two-terminal nonlinear impedance element conductively connected directly to antenna means supported by a tag structure adapted to be secured to a different one of said articles, said non-linear impedance element cooperating with said antenna means when in said zone to reradiate at least a portion of the energy in said wave field in the form of a signal which is different and distinguishable from any signal otherwise present in said wave field, and receiving means to detect said reradiated signal to the exclusion of any signals produced directly by said transmitting means.

10. Passive sensor-emitter means for an article surveillance system comprising a two-terminal nonlinear impedance element conductively connected directly to antenna means supported by a tag structure adapted to be secured to an article under surveillance, said impedance element cooperating with said antenna means when the sensor-emitter means is introduced into an electromagnetic wave field to reradiate at least a portion of the energy in said wave field in the form of a signal which is different and distinguishable from any signal otherwise present in said wave field.

11. Passive sensor-emitter means according to claim 10, wherein the impedance element is adapted to produce a reradiation signal having a frequency equal to the second harmonic of the frequency of the wave field.

12. Passive sensor-emitter means according to claim 11, wherein the impedance element consists of a semiconductor diode.

13. Passive sensor-emitter means according to claim 10, wherein the impedance element consists of a semiconductor diode.

14. A system for detecting the unauthorized removal of protected articles from a predetermined area comprising a. a semiconductor diode chip having a cathode and an anode, b. first and second antenna means respectively electrically connected to said cathode and said anode of said diode chip, said antennas being shaped and dimensioned to receive radio frequency signals at first predetermined frequency level and to retransmit said signals at a second predetermined, relatively higher radio frequency level, c. carrier means for carrying and embedding said diode chip and said antennas for convenient concealment in or association with the article to be protected, d. at least one receiving and transmitting unit positioned near the exit from said area, said unit transmitting radio frequency signals at said first frequency level and receiving radio frequency signals at said second radio frequency level, e. alarm means electrically connected to and actuated by said receiving and transmitting unit when a protected article is in the detectable area around said unit, and f. deactivating means for permanently deactivating the harmonic generator circuit when said protected article has been legitimately purchased and without requiring disassociation of such circuit from said article, said deactivating means comprising a power signal source for transmitting radio frequency signals at a predetermined power level, and antenna means, the power level of said power signal means being substantially higher than the power level of said signal emitted by said receiving and transmitting unit thereby permanently deactivating said harmonic generator circuit.

15. The system of claim 14 wherein said second radio frequency level is approximately twice the frequency of said first frequency level, and the output power of said power signal source is approximately ten times the output power of the transmitted radio frequency signal of said receiving and transmitting unit.

16. The system of claim 15 wherein said receiving and transmitting unit comprises a transmitter including a source of high frequency energy, a filter, and a transmitter antenna, and a receiver comprising a receiving antenna, a band pass filter, a receiver adapted to receive signals of predetermined frequency approximately double the frequency of the signals emitted by said transmitter, and alarm means actuated by said receiver in response to the penetration of a protected article which has not been deactivated into the area of said transmitter.

17. The system of claim 14 wherein said first and second antennas each include a relatively pointed leading end portion adapted to contact and be electrically connected to the cathode and anode, respectively, of said diode chip.

18. A marker for being secured to an object to enable detection of the object within an interrogation zone having an oscillating electromagnetic field, the marker comprising:

a generally ring-shaped electrical conductor for carrying a current induced by said electromagnetic field, a substance which is nonlinearly polarized in response to said electromagnetic field and is electrically connected to said conductor, wherein said marker radiates detectable electromagnetic radiation at a predetermined frequency when disposed within said interrogation zone, and the conductivity of a segment of said ring-shaped conductor being degradable by a predetermined current flow therethrough to permit deactivation of said marker by inducing said predetermined current in said conductor.

19. A system for detecting an object in an interrogation zone comprising:

means proximate the area for producing at least one oscillating electromagnetic field in the zone, a marker associated with each other to be detected for reflecting detectable electromagnetic radiation in response to energy received from said oscillating electromagnetic field, said marker including a ring-shaped electrical conductor for carrying a current induced by said electromagnetic field, and further including a substance which is nonlinearly polarized in response to an electromagnetic field and which is connected to said conductor, means for sensing reflected electromagnetic radiation from said marker in said interrogation zone, and means for deactivating said marker to permit an authorized passage of an object through the zone without detection.

20. A method of detecting an object in an interrogation zone comprising the steps of:

providing each object to be detected with a marker comprising a ring-shaped electrical conductor for carrying a current induced by an electromagnetic field the lines of which link said conductor, and a substance connected to the conductor and which is nonlinearly polarized in response to an electromagnetic field, producing an oscillating electromagnetic field in the interrogation zone to induce a current in the conductor of a marker present in the zone to radiate detectable electromagnetic radiation, detecting in the interrogation zone said radiation, and selectively deactivating said marker when it is not desired to indicate the presence of an object in the interrogation zone.

21. An article surveillance system comprising transmitting means to establish an electromagnetic wave field within a surveillance zone having a given frequency of at least 100 megacycles per second, passive sensor-emitter means for application to an article susceptible of relative movement into said surveillance zone, said sensor-emitter means comprising a two-terminal nonlinear impedance element conductively connected directly to antenna means supported by a structure adapted to be secured to said article under surveillance, said nonlinear impedance element cooperating with said antenna means when in said zone to reradiate at least a portion of the energy in said wave field in the form of a signal having a frequency equal to the second or higher harmonic of said given frequency and which is different and distinguishable from any signal otherwise present in said wave field, and receiving means to detect said reradiated signal to the exclusion of any signals produced directly by said transmitting means, said sensor-emitter means further comprising a capacitive resonator element, said antenna means comprising at least one conductive reradiating antenna member in the form of a loop with an airgap therein across which said capacitive resonator element is connected, and said supporting structure comprising a first ferrite film layer of low retentivity underlying said loop in close proximity thereto, and a second ferrite film layer of high retentivity underlying said first ferrite film layer.

22. An article surveillance system according to clain 21, wherein the antenna means further comprises a second loop with an airgap therein positioned inwardly of the first loop, a second capacitive resonator element connected across said airgap in said second loop, and the nonlinear impedance element comprises a nonlinear capactive element joining said first and second loops.

23. An article surveillance system according to claim 22, wherein the nonlinear capacitive element comprises a reverse-biased diode having auto-biasing, and the thickness of the second ferrite layer is about twice that of the first ferrite layer and is magnetically saturated to tune the loops and activate the sensor-emitter.

24. An article surveillance system comprising transmitting means to establish an electromagnetic wave field within a surveillance zone having a given frequency of at least 100 megacycles per second, passive sensor-emitter means for application to an article susceptible of relative movement into said surveillance zone, said sensor-emitter means comprising a two-terminal nonlinear impedance element conductively connected directly to antenna means supported by a structure adapted to be secured to said article under surveillance, said nonlinear impedance element cooperating with said antenna means when in said zone to reradiate at least a portion of the energy in said wave field in the form of a signal having a frequency equal to the second or higher harmonic of said given frequency and which is different and distinguishable from any signal otherwise present in said wave field, and receiving means to detect said reradiated signal to the exclusion of any signals produced directly by said transmitting means, said antenna means comprising a first conductive loop with an airgap therein, a second conductive loop with an airgap therein positioned inwardly of said first loop, an end of said second loop being connected to an end of said first loop by said impedance element, and a ferrite film layer underlying said loops in close proximity thereto.

25. An article surveillance system according to claim 24, wherein the ferrite film has a relatively square loop hysteresis characteristic and is magnetically saturated to tune said loops and activate the sensor-emitter.

26. An article surveillance system according to claim 24, wherein the outer radius of said second loop is about two-thirds the inner radius of said first loop, said loops have identical radial width, the circumferential extent of said airgaps in said loops is about one-half said radial width, and the overall axial thickness of the sensor-emitter means is a few thousandths of an inch.

27. An article surveillance system comprising transmitting means to establish an electromagnetic wave field within a surveillance zone, passive sensor-emitter means for application to an article susceptible of relative movement into said surveillance zone, said sensor-emitter means comprising a two-terminal nonlinear impedance element conductively connected directly to antenna means supported by a structure adapted to be secured to said article under surveillance, said nonlinear impedance element cooperating with said antenna means when in said zone to reradiate at least a portion of the energy in said wave field in the form of a signal which is different and distinguishable from any signal otherwise present in said wave field, receiving means to detect said reradiated signal to the exclusion of any signals produced directly by said transmitting means, and deactivation means for desensitizing said sensor-emitter means on an article authorized for undetected presence in the surveillance zone, said sensor-emitter means including materials effecting a visible change of color therein upon deactivation of the sensor-emitter.

28. An article surveillance system comprising a transmitting means to establish an electromagnetic wave field within a surveillance zone, passive sensor-emitter means for application to an article susceptible of relative movement into said surveillance zone, said sensor-emitter means comprising a two-terminal nonlinear impedance element conductively connected directly to antenna means supported by a structure adapted to be secured to said article under surveillance, said nonlinear impedance element cooperating with said antenna means when in said zone to reradiate at least a portion of the energy in said wave field in the form of a signal which is different and distinguishable from any signal otherwise present in said wave field, receiving means to detect said reradiated signal to the exclusion of any signals produced directly by said transmitting means, and deactivation means for desensitizing said sensor-emitter means on an article authorized for undetected presence in the surveillance zone, said deactivation means comprising a short range high power transmitter for directing an energy wave at said sensor-emitter means sufficient to burn out the latter.

* * * * *

UNITED STATES PATENT OFFICE

CERTIFICATE OF CORRECTION

PATENT NO. 4,063,229

DATED December 13, 1977

INVENTOR(S) : John Welsh et al.

It is certified that error appears in the above-identified patent and that said Letters Patent are hereby corrected as shown below:

Column 5, line 13, before "formed" should be inserted --an element--.

Column 6, line 67, "type" should read --unit--.

Column 8, line 5, "spuerious" should read --spurious--.

Column 8, line 12, "mode" should read --node--.

Column 8, line 28, "stations" should read --sections--.

Column 9, line 31, "signal" should read --signals--.

Column 10, line 53, "hydrid" should read--hybrid--.

Column 11, line 47, "138" should read --136--.

Column 12, line 53, "registor" should read --resistor--.

Column 12, line 61, "190" should read --160--.

Column 15, line 60, after "transistor" should be inserted --286--.

Column 15, line 62, "193" should read --293--.

Column 21, line 38, after "435" should be inserted --which--

Column 23, line 6, "490" (first instance) should read --490'--.

Column 26, line 53, "other" should read --object--.

On the cover page, item [21] the Appl. No.: "1,970" should read --157,618--.

Signed and Sealed this

Thirtieth Day of May 1978

[SEAL]

Attest:

RUTH C. MASON
Attesting Officer

LUTRELLE F. PARKER
Acting Commissioner of Patents and Trademarks